US007411585B2

(12) United States Patent
Kojima

(10) Patent No.: US 7,411,585 B2
(45) Date of Patent: Aug. 12, 2008

(54) DRIVING VOLTAGE GENERATION DEVICE AND METHOD FOR CONTROLLING DRIVING VOLTAGE GENERATION DEVICE

(75) Inventor: Tomokazu Kojima, Ibaraki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 540 days.

(21) Appl. No.: 11/076,529

(22) Filed: Mar. 10, 2005

(65) Prior Publication Data

US 2005/0206602 A1 Sep. 22, 2005

(30) Foreign Application Priority Data

Mar. 16, 2004 (JP) ..... 2004-074290
Mar. 1, 2005 (JP) ..... 2005-055568

(51) Int. Cl.
*G09G 3/36* (2006.01)

(52) U.S. Cl. ..... 345/204; 345/90

(58) Field of Classification Search ..... 345/88–100, 345/204

See application file for complete search history.

(56) References Cited

U.S. PATENT DOCUMENTS 6,992,508 B2 * 1/2006 Chow ..... 326/86
2003/0151581 A1 8/2003 Suyama et al.

FOREIGN PATENT DOCUMENTS

JP 2003-216256 7/2003

* cited by examiner

*Primary Examiner*—Richard Hjerpe
*Assistant Examiner*—Leonid Shapiro
(74) *Attorney, Agent, or Firm*—McDermott Will & Emery LLP

(57) ABSTRACT

A driving voltage generation device includes: a first selector section for receiving a plurality of first supply voltages and outputting one of the first supply voltages; a second selector section for receiving a plurality of second supply voltages and outputting one of the second supply voltages; first to fourth switches connected in series between the first selector section and the second selector section; a first specified voltage supply section for supplying a first specified voltage to a first interconnection node between the first switch and the second switch; and a second specified voltage supply section for supplying a second specified voltage to a second interconnection node between the third switch and the fourth switch. The first specified voltage supply section does not supply the first specified voltage when the first switch is on. The second specified voltage supply section does not supply the second specified voltage when the fourth switch is on. An output of the first specified voltage supply section has a lower impedance than that of the second selector section. An output of the second specified voltage supply section has a lower impedance than that of the first selector section.

15 Claims, 13 Drawing Sheets

DRIVING VOLTAGE GENERATION DEVICE AND METHOD FOR CONTROLLING DRIVING VOLTAGE GENERATION DEVICE

CROSS REFERENCE TO RELATED APPLICATION

This application claims priority under 35 U.S.C. §119 on Patent Application No. 2004-74290 filed in Japan on Mar. 16, 2004, the entire contents of which are hereby incorporated by reference. The entire contents of Patent Application No. 2005-55568 filed in Japan on Mar. 1, 2005 are also incorporated by reference.

BACKGROUND OF THE INVENTION

1. Field of the Invention

The present invention relates to a device for controlling a driving voltage for driving a load such as a liquid crystal display panel by an AC driving method and a method for controlling such a device. More particularly, the present invention relates to a driving voltage generation device including a circuit of a low-voltage and a method for controlling such a device.

2. Description of the Background Art

In order to drive a liquid crystal display panel of a portable device (e.g., a mobile telephone) by an AC driving method (e.g., horizontal line inversion driving method), a conventional liquid crystal display driving device includes a driving voltage generation device for controlling a driving voltage supplied to the counter electrode of the liquid crystal display panel. The driving voltage generation device inverts the polarity of the driving voltage according to a predetermined timing.

Conventional Driving Voltage Generation Device 8

Configuration and Operation

FIG. 12 shows a general configuration of a conventional driving voltage generation device 8. The device 8 includes a timing control section 81, a VCOM voltage generation section 82, a VCOM operational amplifier 83, a smoothing capacitor C84 and an output terminal 85. The device 8 alternately outputs driving voltages VCOMH and VCOML to the counter electrode (not shown) of the liquid crystal display panel.

The timing control section 81 uses control signals Sa and Sb to control the voltage values of the driving voltages VCOMH and VCOML generated by the VCOM voltage generation section 82.

The VCOM voltage generation section 82 includes ladder resistors 801H and 801L, selector sections 802H and 802L and switch transistors SW3 and SW4.

The ladder resistor 801H and the selector section 802H have a configuration as shown in FIG. 2A, for example. The ladder resistor 801H generates a plurality of supply voltages of different voltage values. The selector section 802H includes a plurality of selection transistors. The selector section 802H selects one of the plurality of supply voltages generated by the ladder resistor 801H according to the control signal Sa from the timing control section 81. The control signal Sa has a voltage value equal to the potential difference ((reference voltage VREFH)−(reference voltage VSSH)) between a reference node N801H-1 and a reference node N801H-2. The supply voltage selected by the selector section 802H is output as the driving voltage VCOMH.

The ladder resistor 801L and the selector section 802L have a configuration as shown in FIG. 2B, for example. The ladder resistor 801L generates a plurality of supply voltages of different voltage values. The selector section 802L includes a plurality of selection transistors. The selector section 802L selects one of the plurality of supply voltages generated by the ladder resistor 801L according to the control signal Sb from the timing control section 81. The control signal Sb has a voltage value equal to the potential difference ((reference voltage VSSL)−(reference voltage VREFL)) between a reference node N801L-1 and a reference node N801L-2. The supply voltage selected by the selector section 802L is output as the driving voltage VCOML.

The switch transistors SW3 and SW4 are connected in series between the selector section 802H and the selector section 802L. The timing control section 81 alternately brings control signals S3 and S4 to "H level" as shown in FIG. 3C and FIG. 3D according to a timing signal TIMING from outside. The control signals S3 and S4 being at "H level" are voltages that turn on the switch transistors SW3 and SW4, and the control signals S3 and S4 being at "L level" are voltages that turn off the switch transistors SW3 and SW4. Thus, the driving voltage VCOMH from the selector section 802H and the driving voltage VCOML from the selector section 802L are alternately supplied to an interconnection node NC between the switch transistor SW3 and the switch transistor SW4.

The VCOM operational amplifier 83 outputs the driving voltages VCOMH and VCOML supplied from the VCOM voltage generation section 82 to the output terminal 85. The smoothing capacitor C84 is provided for smoothing the fluctuations in the output of the VCOM operational amplifier 83, and is connected between a node N84 (a node between the VCOM operational amplifier 83 and the output terminal 85) and a ground node.

The driving voltages VCOMH and VCOML output from the VCOM operational amplifier 83 are supplied to the counter electrode of the liquid crystal display panel via the output terminal 85 (a panel load C(LC) is shown herein as the load capacitor of the liquid crystal display panel).

Herein, the following relationships hold true:

(reference voltage VREFL)≦(reference voltage VSSH)≦(reference voltage VREFH); and (reference voltage VREFL)≦(reference voltage VSSL)≦(reference voltage VREFH).

Specifically, (voltage value of reference voltage VREFH)="+5 V", (voltage value of reference voltages VSSH and VSSL)= "0 V", and (voltage value of reference voltage VREFL)="−5 V".

Voltage Value of Supply Voltage

The maximum voltage value of the supply voltage generated by the ladder resistor 801H is equal to the potential at the reference node N801H-1 (reference voltage VREFH="+5 V"). Therefore, the maximum voltage value of the driving voltage VCOMH is "+5 V". The minimum voltage value of the supply voltage generated by the ladder resistor 801L is equal to the potential at the reference node N801L-2 (reference voltage VREFL="−5 V"). Therefore, the minimum voltage value of the driving voltage VCOML is "−5 V".

Breakdown Voltage of Switching Transistors SW3 and SW4

The maximum voltage difference across the switch transistor SW3 is 10 V ((reference voltage VREFH="+5")−(reference voltage VREFL="−5 V")). As with the switch transistor SW3, the maximum voltage difference across the switch transistor SW4 is also 10 V ((reference voltage VREFH="+5")−(reference voltage VREFL="−5 V")). Therefore, the switch transistors SW3 and SW4 need to have a breakdown voltage of 10 V.

Conventional Driving Voltage Generation Device 9

Configuration and Operation

FIG. 13 shows a general configuration of another conventional driving voltage generation device 9. The device 9 includes a timing control section 91 and a VCOM voltage generation section 92, instead of the timing control section 81 and the VCOM voltage generation section 82 shown in FIG. 12. Other than this, the configuration is similar to that shown in FIG. 12.

The timing control section 91 uses the control signal Sa and amplitude information Sc to control the voltage values of the driving voltages VCOMH and VCOML generated by the VCOM voltage generation section 92. The amplitude information Sc represents a voltage (amplitude voltage VREFM) having a voltage value according to the voltage difference (amplitude) between the driving voltage VCOMH and the driving voltage VCOML.

The VCOM voltage generation section 92 includes a supply operational amplifier 901, a selection operational amplifier 902, supply transistors T903-1 to T903-4 and resistors R904 and R905, instead of the ladder resistor 801L and the selector section 802L shown in FIG. 12. The selection operational amplifier 902, the supply transistor T903-1 and the resistor R904 together form a voltage-current conversion circuit. Therefore, a supply current having a current value according to the voltage value of the amplitude information Sc (amplitude voltage VREFM) flows through the supply transistor T903-1 and the resistor R904. The supply transistors T903-1 and T903-2 together form a current mirror circuit, and the supply transistors T903-3 and T903-4 together form another current mirror circuit, whereby a supply current that flows through the supply transistor T903-1 flows through the resistor R905 and the supply transistor T903-4. Thus, the driving voltage VCOML is generated at an interconnection node N905L between the resistor R905 and the supply transistor T903-4.

(driving voltage VCOML)=(driving voltage VCOMH)−(amplitude voltage VREFM)×(resistance R905)/(resistance R904)

Then, as the switch transistors SW3 and SW4 are alternately turned on, the driving voltage VCOMH from the supply operational amplifier 901 and the driving voltage VCOML generated at the node N905L are alternately supplied to the node NC.

Herein, the following relationships hold true:

(reference voltage VREFL)≦(reference voltage VSSH)≦(reference voltage VREFH); and (reference voltage VREFL)≦(reference voltage VSS)≦ (reference voltage VREFH).

Specifically, (voltage value of reference voltage VREFH)="+5 V", (voltage value of reference voltages VSSH and VSS)="0 V", and (voltage value of reference voltage VREFL)="−5 V".

Voltage Value of Supply Voltage

The maximum voltage value of the supply voltage generated by the ladder resistor 801H is equal to the potential at the reference node N801H-1 (reference voltage VREFH="+5 V"). Therefore, the maximum voltage value of the driving voltage VCOMH is "+5 V". The minimum voltage value of the driving voltage VCOML generated at a node N905L is equal to the potential at a reference node N901L-5 (reference voltage VREFL="−5 V"). Therefore, as with the driving voltage generation device shown in FIG. 12, the switch transistors SW3 and SW4 need to have a breakdown voltage of 10 V.

SUMMARY OF THE INVENTION

However, in the conventional driving voltage generation device 8 shown in FIG. 12, when the switch transistor SW3 transitions from off to on and the switch transistor SW4 transitions from on to off, the potential at a node N802H present between the selector section 802H and the switch transistor SW3 may possibly decrease to the voltage value of the driving voltage VCOML. Then, the potential difference across one or more of the plurality of selection transistors included in the selector section 802H is "(reference voltage VREFH)−(reference voltage VREFL)". Therefore, the plurality of selection transistors included in the selector section 802H need to have a breakdown voltage of 10 V ((+5 V)−(−5 V)) (i.e., the absolute maximum rating thereof needs to be greater than 10 V) even though the voltage value of the control signal Sa is 5 V ((+5 V)−(0 V)). When the switch transistor SW4 transitions from off to on and the switch transistor SW3 transitions from on to off, the potential at a node N802L present between the selector section 802L and the switch transistor SW4 may possibly increase to the voltage value of the driving voltage VCOMH, the selection transistors included in the selector section 802L also need to have a breakdown voltage of 10 V, as with the selector section 802H. Thus, the selector sections 802H and 802L need to have a circuit configuration with a high-voltage (high-voltage circuit).

Generally, a high-voltage transistor has a larger area than that of a low-voltage transistor. Specifically, a transistor whose breakdown voltage is "10 V" has an area about four times as larger as that of a transistor whose breakdown voltage is "5 V". Assuming that the driving voltages VCOMH and VCOML have 64 different voltage levels, the area of the selector section 802H shown in FIG. 12 using transistors whose breakdown voltage is "10 V" is about 500 times as larger as that in a case where selection transistors whose breakdown voltage is 5 V are used in the selector section 802H shown in FIG. 12.

Moreover, in recent years, there is an increasing demand for a higher resolution for a liquid crystal display panel in a mobile telephone, etc. With the increase in the resolution of a liquid crystal display panel, it is necessary to increase the number of voltage levels of the driving voltages VCOMH and VCOML (i.e., the number of different supply voltages to be generated by the ladder resistors 801H and 801L). The increase in the number of supply voltages also increases the number of selection transistors included in the selector sections 802H and 802L. Since the increase in the resolution of a liquid crystal display panel increases the circuit scale of a driving voltage generation device, it is important to reduce the circuit scale of a driving voltage generation device.

With the driving voltage generation device 9 shown in FIG. 13, the potential at the node N905L may possibly increase to "+5 V". Therefore, the supply transistor T903-4 need to have a breakdown voltage of 10 V ((+5 V)−(−5 V)). Moreover, the potential difference across each of the supply transistors T903-2 and T903-3 may possibly become equal to "(reference voltage VREFH)−(reference voltage VREFL)". Therefore, the supply transistors T903-3 and T903-4 need to have a breakdown voltage of 10 V ((+5 V)−(−5 V)). In the current mirror circuit formed by the supply transistors T903-1 and T903-2, it is preferred that the supply transistors T903-1 and T903-2 have equal current characteristics. Therefore, the supply transistor T903-1 needs to have a breakdown voltage of 10 V ((+5 V)−(−5 V)). The potential difference across the supply operational amplifier 901 may also become equal to "(reference voltage VREFH)−(reference voltage VREFL)". Therefore, the supply operational amplifier 901 needs to be formed by transistors having a breakdown voltage of 10 V. Thus, the selector section 802H, the supply operational amplifier 901 and the supply current generation section (the selection operational amplifier 902, the supply transistors T903-1 to T903-4 and the resistors R904 and R905) need to have a circuit configuration with a high-voltage (high-voltage circuit).

Generally, the higher the breakdown voltage of a transistor is, the lower the response speed of the transistor is. Generally, high voltage transistor has a greater variation in the process (process variation) than low-voltage transistor has. Therefore, a current mirror circuit formed by high voltage transistors has a greater variation of current characteristic than that formed by low-voltage transistors has. As for operational amplifiers, an operational amplifier using a high-voltage transistor has a lower driving power (response speed) than an operational amplifier using a low-voltage transistor. Therefore, with the driving voltage generation device 9 shown in FIG. 13, it is difficult to accurately generate the driving voltages VCOMH and VCOML according to the control signal Sa and the amplitude information Sc.

It is therefore an object of the present invention to provide a driving voltage generation device having a low-voltage circuit.

According to one aspect of the present invention, a driving voltage generation device includes: a first selector section for receiving a plurality of first supply voltages and outputting one of the first supply voltages; a second selector section for receiving a plurality of second supply voltages and outputting one of the second supply voltages; first to fourth switches connected in series between the first selector section and the second selector section; a first specified voltage supply section for supplying a first specified voltage to a first interconnection node between the first switch and the second switch; and a second specified voltage supply section for supplying a second specified voltage to a second interconnection node between the third switch and the fourth switch. The first switch is connected between the first selector section and the second switch. The second switch is connected between the first switch and the third switch. The third switch is connected between the second switch and the fourth switch. The fourth switch is connected between the third switch and the second selector section. The first specified voltage supply section does not supply the first specified voltage when the first switch is on. The second specified voltage supply section does not supply the second specified voltage when the fourth switch is on. An output of the first specified voltage supply section has a lower impedance than that of the second selector section. An output of the second specified voltage supply section has a lower impedance than that of the first selector section.

With the driving voltage generation device, the voltage generated at the third interconnection node between the second switch and the third switch is supplied to the subsequent device. For example, if the second switch and the third switch are alternately turned on, the voltage at the first interconnection node and the voltage at the second interconnection node can be alternately supplied to the subsequent device. Either the output of the first selector section or the output of the first specified voltage supply section is supplied to the first interconnection node. Either the output of the second selector section or the output of the second specified voltage supply section is supplied to the second interconnection node. Therefore, by appropriately turning on/off the first to fourth switches, it is possible to supply either the output of the first selector section or the output of the second selector section to the subsequent device. If the first switch is turned off before the transition from a state where the third and fourth switches are on and the second switch is off (where the output of the second selector section is being supplied to the third interconnection node) to another state where the second switch is on and the third switch is off, it is then possible to supply the output of the first specified voltage supply section to the first interconnection node before the second switch transitions from off to on. Since the impedance of the output of the first specified voltage supply section is lower than that of the output of the second selector section, the potential at the first interconnection node stays stable at the voltage value of the first specified voltage. Similarly, if the fourth switch is turned off before the transition from a state where the first and second switches are on and the third switch is off (where the output of the first selector section is being supplied to the third interconnection node) to another state where the third switch is on and the second switch is off, it is then possible to supply the output of the second specified voltage supply section to the second interconnection node before the third switch transitions from off to on. Since the impedance of the output of the second specified voltage supply section is lower than that of the output of the first selector-section, the potential at the second interconnection node stays stable at the voltage value of the first specified voltage. By setting the voltage value of the first specified voltage to an appropriate value (e.g., the voltage value indicated by the output of the first selector section), the potential difference between the input side and the output side in the first selector section can be made smaller than that in the prior art. Therefore, it is possible to reduce the breakdown voltage of the first selector section (e.g., by using low-voltage transistors). Similarly, by setting the voltage value of the second specified voltage to an appropriate value (e.g., the voltage value indicated by the output of the second selector section), the potential difference between the input side and the output side in the second selector section can be made smaller than that in the prior art. Therefore, it is possible to reduce the breakdown voltage of the second selector section (e.g., by using low-voltage transistors). Thus, the breakdown voltage can be reduced for each of the first and second selector sections, whereby it is possible to reduce the circuit scale.

Preferably, the driving voltage generation device further includes: a first ladder resistor connected in series between a first reference node receiving a first reference voltage and a second reference node receiving a second reference voltage for generating N (N is a natural number) first supply voltages of different voltage levels; and a second ladder resistor connected in series between a third reference node receiving a third reference voltage and a fourth reference node receiving a fourth reference voltage for generating M (M is a natural number) second supply voltages of different voltage levels. The first selector section outputs one of the N first supply voltages generated by the first ladder resistor. The second selector section outputs one of the M second supply voltages generated by the second ladder resistor. The first specified voltage supply section includes a fifth switch connected between a first input node receiving the first specified voltage and the first interconnection node. The second specified voltage supply section includes a sixth switch connected between a second input node receiving the second specified voltage and the second interconnection node. The fifth switch is off when the first switch is on. The sixth switch is off when the fourth switch is on.

With the driving voltage generation device, if the fifth switch is turned on before the transition from a state where the output of the second selector section is being supplied to the third interconnection node to another state where the second switch is on and the third switch is off, it is then possible to supply the first specified voltage to the first interconnection node before the second switch transitions from off to on. Similarly, if the sixth switch is turned on before the transition from a state where the output of the first selector section is being supplied to the third interconnection node to another state where the third switch is on and the second switch is off, it is then possible to supply the second specified voltage to the second interconnection node before the third switch transitions from off to on.

Preferably, the driving voltage generation device further includes a control section for controlling the first to sixth switch transistors, the control section having first to fourth modes. In the first mode, the control section turns off the first, second and sixth switch transistors and turns on the third, fourth and fifth switch transistors. In the second mode, the control section turns off the first, third and sixth switch transistors and turns on the second, fourth and fifth switch transistors. In the third mode, the control section turns on the first, second and sixth switch transistors and turns off the third, fourth and fifth switch transistors. In the fourth mode, the control section turns on the first, third and sixth switch transistors and turns off the second, fourth and fifth switch transistors.

According to another aspect of the present invention, a driving voltage generation device includes: a first selector section for receiving a plurality of first supply voltages and selecting one of the first supply voltages; a supply current generation section for generating a supply current having a current value according to an amplitude signal indicating a predetermined potential difference; first to fourth switches connected in series between the first selector section and the supply current generation section; a first line connecting the first selector section and the first switch with each other; a second line connecting the supply current generation section and the fourth switch with each other; a first resistor connected between a first node along the first line and a second node along the second line; a clamp circuit connected to the first line for restricting a potential at the first line within a predetermined range; a first specified voltage supply section for outputting a first specified voltage to a first interconnection node between the first switch and the second switch; and a second specified voltage supply section for outputting a second specified voltage to a second interconnection node between the third switch and the fourth switch. The first switch is connected between the first selector section and the second switch. The second switch is connected between the first switch and the third switch. The third switch is connected between the second switch and the fourth switch. The fourth switch is connected between the third switch and the supply current generation section. The first specified voltage supply section does not output the first specified voltage when the first switch is on. The second specified voltage supply section does not output the second specified voltage when the fourth switch is on. An impedance of an output of the first specified voltage supply section is lower than that of an output of the supply current generation section. An impedance of an output of the second specified voltage supply section is lower than that of an output of the first selector section.

With the driving voltage generation device, the potential difference between the input side and the output side in the supply current generation section can be made smaller than that in the prior art (e.g., by using low-voltage transistors in the supply current generation section). Thus, it is possible to reduce the circuit scale.

According to still another aspect of the present invention, a method for controlling a driving voltage generation device is provided. The driving voltage generation device includes: a first selector-section for receiving a plurality of first supply voltages and outputting one of the first supply voltages; a second selector section for receiving a plurality of second supply voltages and outputting one of the second supply voltages; first to fourth switches connected in series between the first selector section and the second selector section; a fifth switch connected between a first interconnection node and a first input node receiving a first specified voltage, the first interconnection node being present between the first switch and the second switch; and a sixth switch connected between a second interconnection node and a second input node receiving a second specified voltage, the second interconnection node being present between the third switch and the fourth switch. An impedance of the first specified voltage supplied via the fifth switch is lower than that of an output of the second selector section. An impedance of the second specified voltage supplied via the sixth switch is lower than an output of the first selector section. The control method includes: a step (A) of turning off the first, second and sixth switches and turning on the third, fourth and fifth switches; a step (B) of turning off the first, second and sixth switches and turning on the third, fourth and fifth switches; a step (C) of turning on the third switch and turning on the second switch, and then turning on the first and sixth switches and turning off the fourth and fifth switches, the step (C) being performed when an operation is switched from the step (A) to the step (B); and a step (D) of turning on the second switch and turning off the third switch, and then turning on the fourth and sixth switches and turning off the first and sixth switches, the step (D) being performed when an operation is switched from the step (B) to the step (A).

With the method for controlling a driving voltage generation device, in the step (A), the output of the second selector section is supplied to the interconnection node (third interconnection node) between the second switch and the third switch. Moreover, the first specified voltage is supplied to the first interconnection node. In the step (C), since the first specified voltage is being supplied to the first interconnection node, the potential at the first interconnection node stays stable at the voltage value of the first specified voltage. In the step (B), the output of the first selector section is supplied to the third interconnection node. Moreover, the second specified voltage is supplied to the second interconnection node. In the step (D), since the second specified voltage is being supplied to the second interconnection node, the potential at the second interconnection node stays stable at the voltage value of the second specified voltage. By setting the voltage value of the first specified voltage (second specified voltage) to an appropriate value, the potential difference between the input side and the output side in the first selector section (second selector section) can be made smaller than that in the prior art. Therefore, it is possible to reduce the breakdown voltage of the first and second selector sections. Thus, the breakdown voltage can be reduced for each of the first and second selector sections, whereby it is possible to reduce the circuit scale of the driving voltage generation device.

As described above, the potential difference between the input side and the output side in the first selector section (second selector section) can be made smaller than that in the prior art. Therefore, it is possible to reduce the breakdown voltage of the first and second selector sections. Thus, the breakdown voltage can be reduced for each of the first and second selector sections, whereby it is possible to reduce the circuit scale of the driving voltage generation device.

DESCRIPTION OF THE PREFERRED EMBODIMENTS

Figure 1:
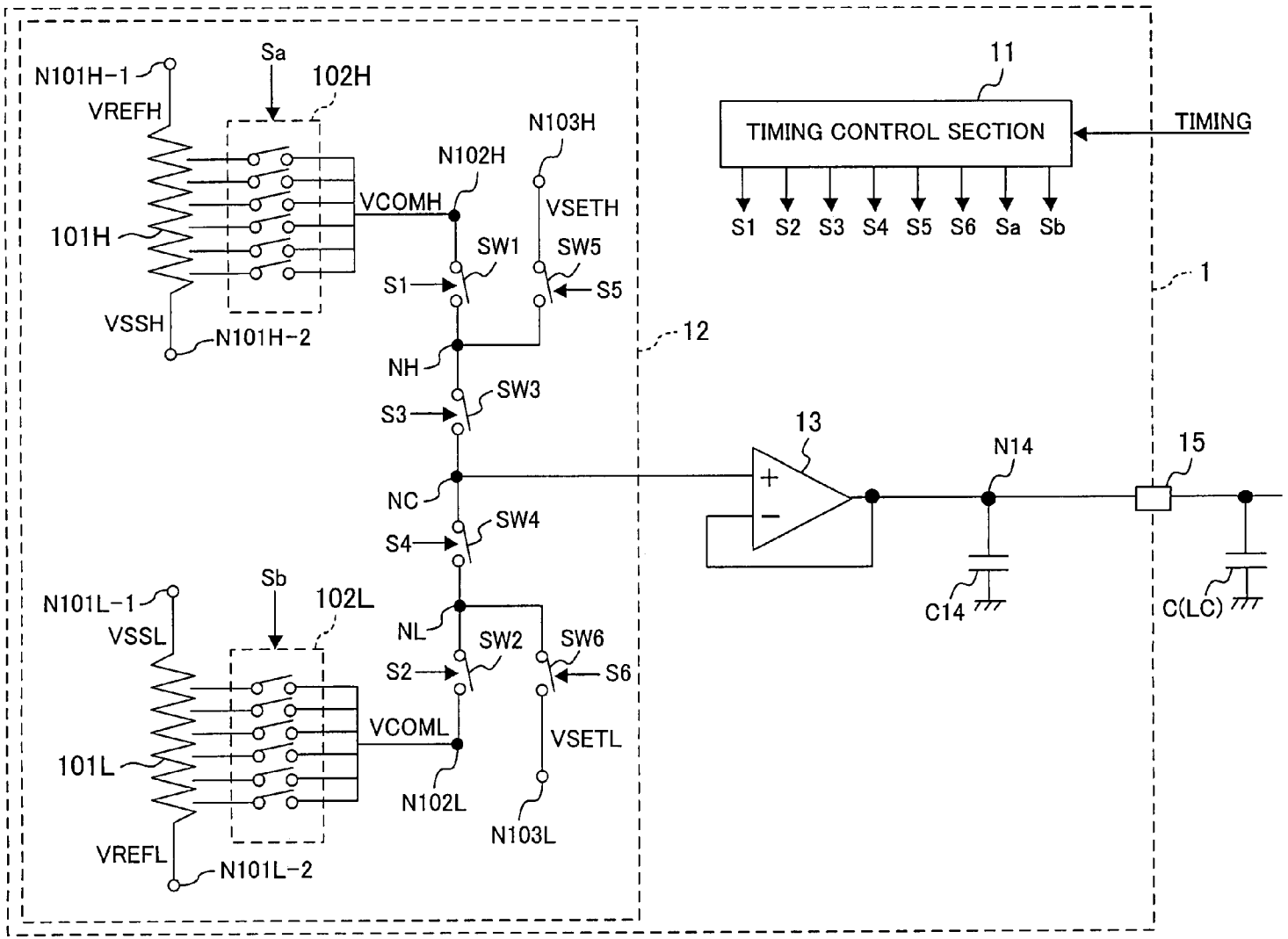
FIG. 1 shows a general configuration of a driving voltage generation device according to a first embodiment of the present invention.

Preferred embodiments of the present invention will now be described in detail with reference to the drawings. Like elements are denoted by like reference numerals throughout the various figures, and will not be described repeatedly.

First Embodiment

General Configuration

FIG. 1 shows a general configuration of a driving voltage generation device 1 according to a first embodiment of the present invention. The device 1 includes a timing control section 11, a VCOM voltage generation section 12, a VCOM operational amplifier 13, a smoothing capacitor C14 and an output terminal 15. The device 1 controls the driving voltages VCOMH and VCOML for driving a liquid crystal display panel by an AC driving method (line inversion driving method). Specifically, the device 1 outputs one of the driving voltages VCOMH and VCOML to the counter electrode (not shown) of the liquid crystal display panel according to the timing signal TIMING.

The timing control section 11 uses the control signal Sa to control the voltage value of the driving voltage VCOMH output by the VCOM voltage generation section 12. The timing control section 11 uses the control signal Sb to control the voltage value of the driving voltage VCOML output by the VCOM voltage generation section 12. The timing control section 11 outputs control signals S1 to S6 according to the timing signal TIMING from outside. The timing signal TIMING indicates the timing according to which the driving voltage supplied to the counter electrode of the liquid crystal display panel is switched from the driving voltage VCOMH to the driving voltage VCOML (or from the driving voltage VCOML to the driving voltage VCOMH).

The VCOM voltage generation section 12 generates the driving voltages VCOMH and VCOML according to the control signals Sa and Sb output from the timing control section 11. The VCOM voltage generation section 12 outputs one of the driving voltages VCOMH and VCOML according to the control signals S1 to S6 output from the timing control section 11.

The VCOM operational amplifier 13 outputs the driving voltages VCOMH and VCOML from the VCOM voltage generation section 12 to the output terminal 15.

The smoothing capacitor C14 is provided for smoothing the fluctuations in the output of the VCOM operational amplifier 13, and is connected between a node N14 (a node between the VCOM operational amplifier 13 and the output terminal 15) and a ground node.

The driving voltages VCOMH and VCOML output from the VCOM operational amplifier 13 are supplied to the counter electrode of the liquid crystal display panel via the output terminal 15 (a panel load C(LC) is shown herein as the load capacitor of the liquid crystal display panel).

Internal Configuration of VCOM Voltage Generation Section 12

The VCOM voltage generation section 12 shown in FIG. 1 includes ladder resistors 101H and 101L, selector sections 102H and 102L and switch transistors SW1 to SW6.

The ladder resistor 101H is connected between a reference node N101H-1 receiving the reference voltage VREFH and a reference node N101H-2 receiving the reference voltage VSSH, and generates a plurality of supply voltages of different voltage values. The selector section 102H selects one of the plurality of supply voltages generated by the ladder resistor 101H according to the control signal Sa from the timing control section 11.

The ladder resistor 101L is connected between a reference node N101L-1 receiving the reference voltage VSSL and a reference node N101L-2 receiving the reference voltage VREFL, and generates a plurality of supply voltages of different voltage values. The selector section 102L selects one of the plurality of supply voltages generated by the ladder resistor 101L according to the control signal Sb from the timing control section 11.

The switch transistors SW1 to SW4 are connected in series between the selector section 102H and the selector section 102L. The supply voltage selected by the selector section 102H is supplied to the switch transistor SW1 as the driving voltage VCOMH. The supply voltage selected by the selector section 102L is supplied to the switch transistor SW2 as the driving voltage VCOML. The switch transistor SW1 is connected between the selector section 102H and the switch transistor SW3, and receives at the gate thereof the control signal S1 from the timing control section 11. The switch transistor SW3 is connected between the switch transistor SW1 and the switch transistor SW4, and receives at the gate thereof the control signal S1 from the timing control section 11. The switch transistor SW4 is connected between the switch transistor SW3 and the switch transistor SW2, and receives at the gate thereof the control signal S4 from the timing control section 11. The switch transistor SW2 is connected between the switch transistor SW4 and the selector section 102L, and receives at the gate thereof the control signal S2 from the timing control section 11.

The switch transistor SW5 is connected between an interconnection node NH (a node between the switch transistor SW1 and the switch transistor SW3) and a specified voltage supply node N103H, and receives at the gate thereof the control signal S5 from the timing control section 11. The specified voltage supply node N103H receives a specified voltage VSETH from outside (e.g., from the power supply unit). The switch transistor SW6 is connected between an interconnection node NL (a node between the switch transistor SW4 and the switch transistor SW2) and a specified voltage supply node N103L, and receives at the gate thereof the control signal S6 from the timing control section 11. The specified voltage supply node N103L receives a specified voltage VSETL from outside (e.g., from the power supply unit).

The switch transistors SW1 to SW6 are turned on when the control signals S1 to S6, respectively, are at "H level" and off when they are at "L level".

Herein, the following relationship holds true:

(reference voltage VREFL)≦(reference voltages VSSH and VSSL)≦(reference voltage VREFH).

The following relationships also hold true:

(reference voltage VSSH)≦(specified voltage VSETH)≦(reference voltage VREFH); and (reference voltage VREFL)≦(specified voltage VSETL)≦(reference voltage VSSL).

Exemplary Configuration of Ladder Resistor 101H and Selector Section 102H

Figure 2B:
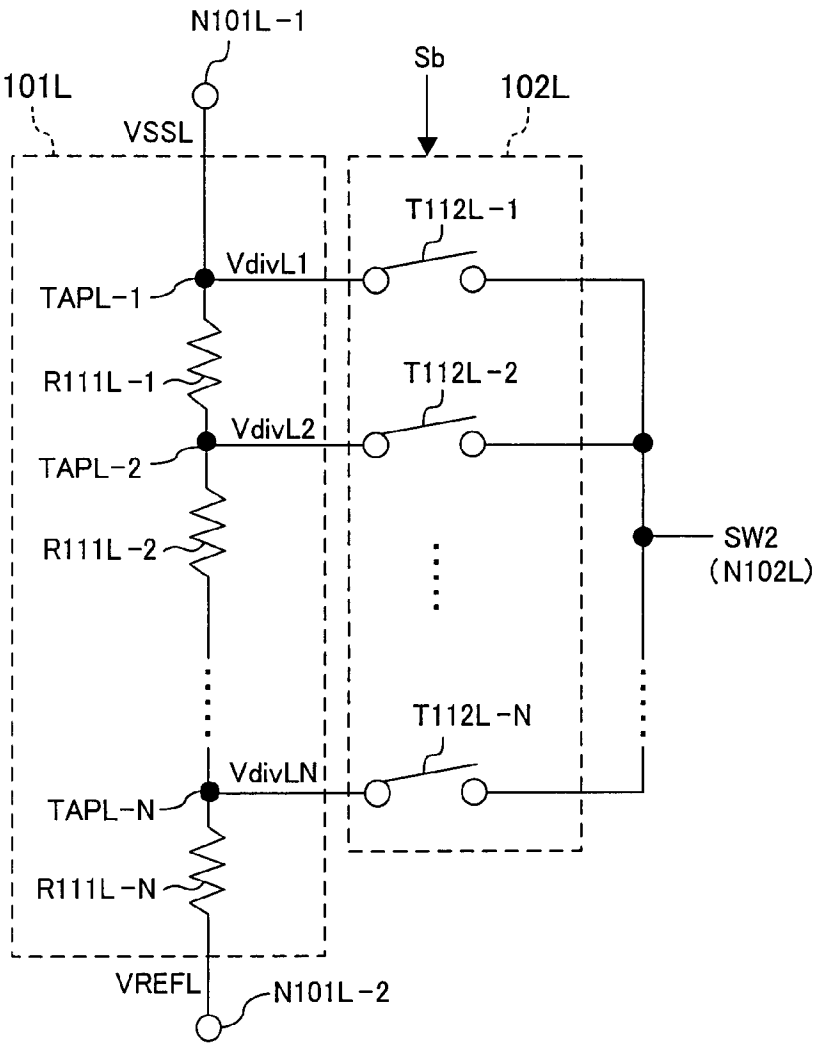
FIG. 2B shows an exemplary configuration of a ladder resistor 101L and a selector section 102L shown in FIG. 1.
Figure 2A:
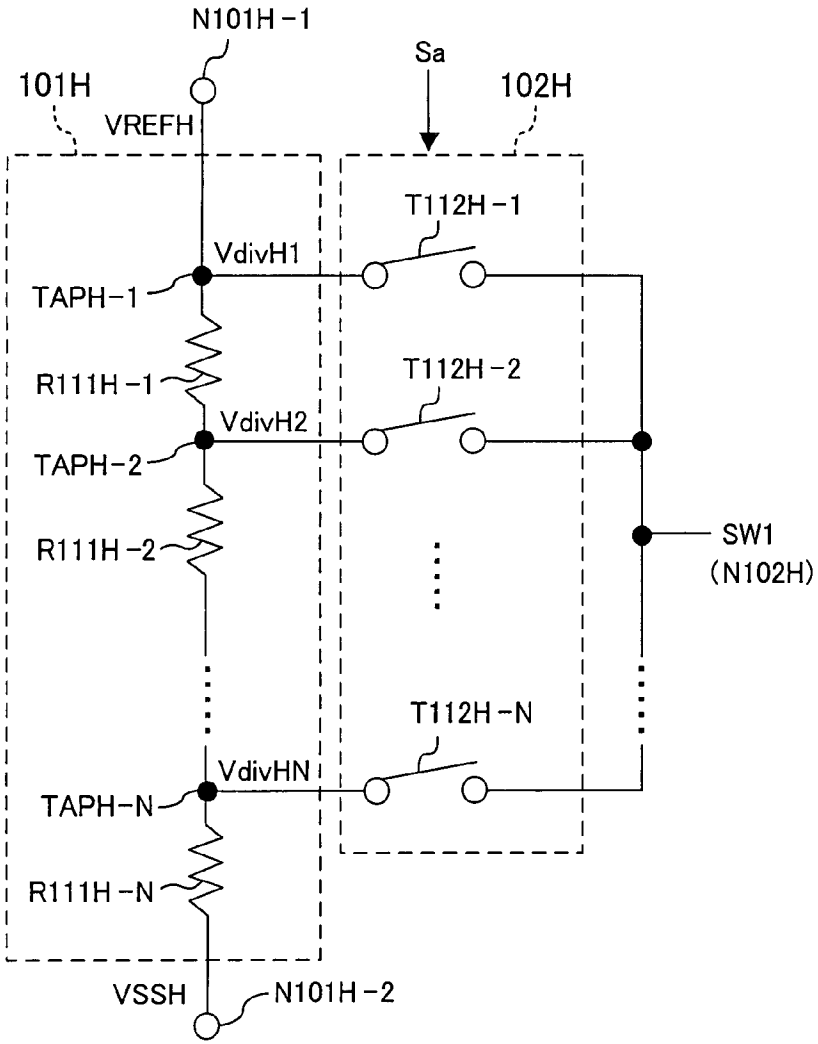
FIG. 2A shows an exemplary configuration of a ladder resistor 101H and a selector section 102H shown in FIG. 1.
Figure 3:
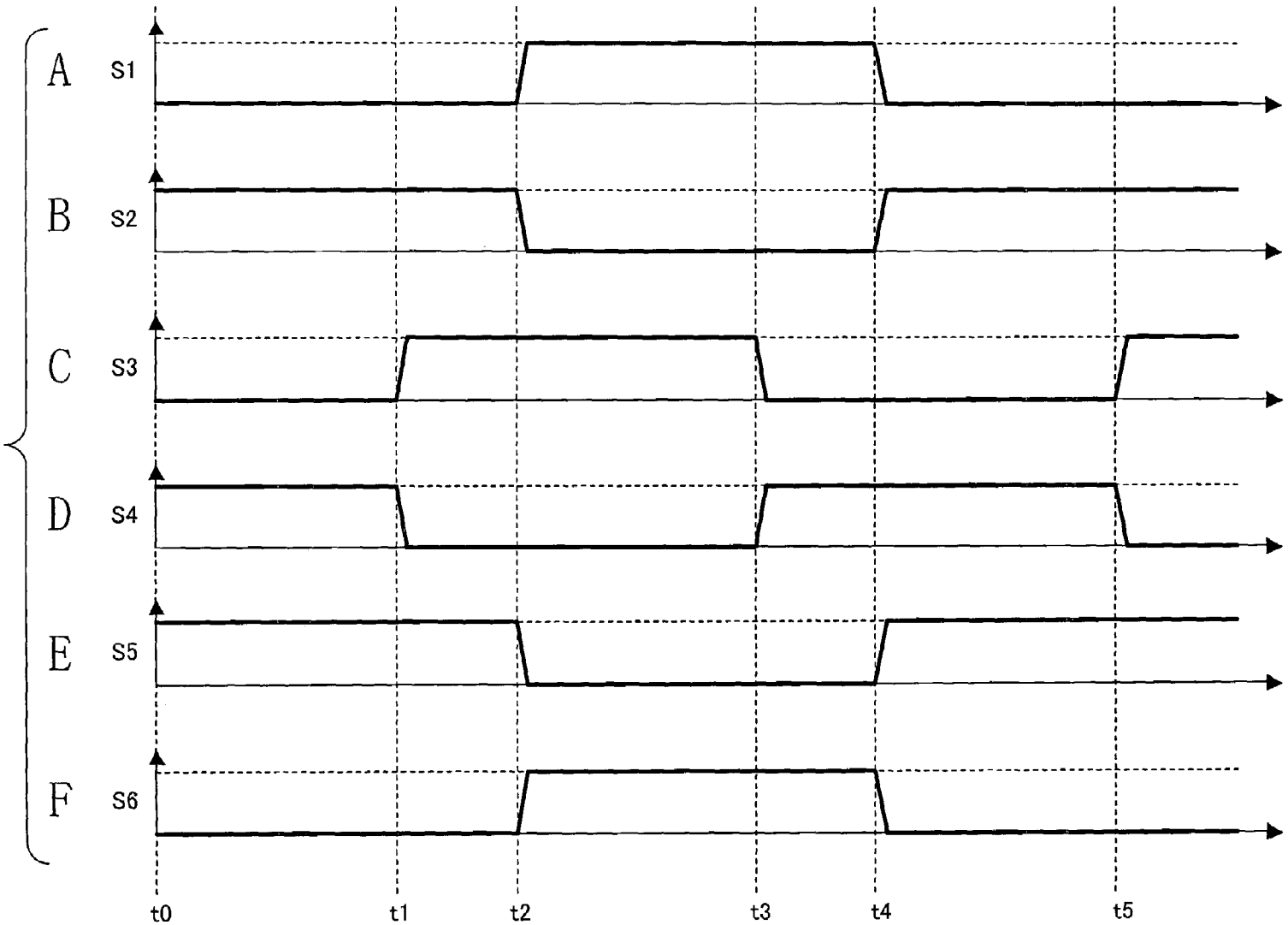
FIG. 3A to FIG. 3F are waveform diagrams showing an example of control signals S1 to S6.

FIG. 2A shows an exemplary configuration of the ladder resistor 101H and the selector section 102H. The ladder resistor 101H includes N (N is a natural number) resistors R111H-1 to R111H-N. The resistors R111H-1 to R111H-N are connected in series between the reference node N101H-1 and the reference node N101H-2. N different supply voltages VdivH1 to VdivHN are generated at N taps TAPH-1 to TAPH-N, respectively, of the ladder resistor 101H. The selector section 102H includes N selection transistors T112H-1 to T112H-N. The selection transistors T112H-1 to T112H-N are connected between the taps TAPH-1 to TAPH-N and the switch transistor SW1. The timing control section 11 gives the control signal Sa to the gate of one of the selection transistors T112H-1 to T112H-N. The voltage value of the control signal Sa indicates "(reference voltage VREFH)−(reference voltage VSSH)". As one of the selection transistors T112H-1 to T112H-N is turned on, one of the N supply voltages VdivH1 to VdivHN is supplied to the switch transistor SW1 as the driving voltage VCOMH. Thus, the driving voltage VCOMH is generated with N different levels, the reference voltage VREFH being the highest level.

Exemplary Configuration of Ladder Resistor 101L And Selector Section 102L

FIG. 2B shows an exemplary configuration of the ladder resistor 101L and the selector section 102L. The ladder resistor 101L includes N resistors R111L-1 to R111L-N. The resistors R111L-1 to R111L-N are connected in series between the reference node N101L-1 and the reference node N101L-2. N different supply voltages VdivL1 to VdivLN are generated at N taps TAPL-1 to TAPL-N, respectively, of the ladder resistor 101L. The selector section 102L includes N selection transistors T112L-1 to T112L-N. The selection transistor T112L-1 is connected between the tap TAPL-1 and the switch transistor SW2. As is the selection transistor T112L-1, the selection transistors T112L-2 to T112L-N are connected between the taps TAPL-2 to TAPL-N and the switch transistor SW2. The timing control section 11 gives the control signal Sb to the gate of one of the selection transistors T112L-1 to T112L-N. The voltage value of the control signal Sb indicates "(reference voltage VSSL)−(reference voltage VREFL)". As one of the selection transistors T112L-1 to T112L-N is turned on, one of the N supply voltages VdivL1 to VdivLN is supplied to the switch transistor SW2 as the driving voltage VCOML. Thus, the driving voltage VCOML is generated with N different levels, the reference voltage VREFL being the lowest level.

Resistance Value

Generally, in a driving voltage generation device, the ladder resistor has a relatively high resistance value so as to reduce the current flowing through the ladder resistor. For example, the resistance value of the ladder resistor 101H is about a few hundred kΩ to about a few MΩ (megohms). The on resistance of the switch transistor SW5 may be significantly smaller than the resistance value of the ladder resistor 101L. For example, the on resistance of the switch transistor SW5 is about 50 Ω. As with the switch transistor SW5, the on resistance of the switch transistor SW6 is significantly smaller than the resistance value of the ladder resistor 101H.

Operation of VCOM Voltage Generation Section 12

Next, the operation of the VCOM voltage generation section 12 shown in FIG. 1 will be described with reference to FIG. 3A to FIG. 3F and FIG. 4A to FIG. 4C. Herein, the voltage value of the reference voltage VREFH is "+5 V", the voltage value of the reference voltages VSSH and VSSL is "0 V", and the voltage value of the reference voltage VREFL is "−5 V". The voltage value of the specified voltage VSETH is "+4 V", and the voltage value of the specified voltage VSETL is "−4 V". The selector section 102H receives the control signal Sa to select a supply voltage having a voltage value of "+5 V", and the selector section 102L receives the control signal Sb to select a supply voltage having a voltage value of "−5 V". Thus, the driving voltage VCOMH having a voltage value of "+5 V" is supplied to a node N102H, and the driving voltage VCOML having a voltage value of "−5 V" is supplied to a node N102L.

Figure 4:
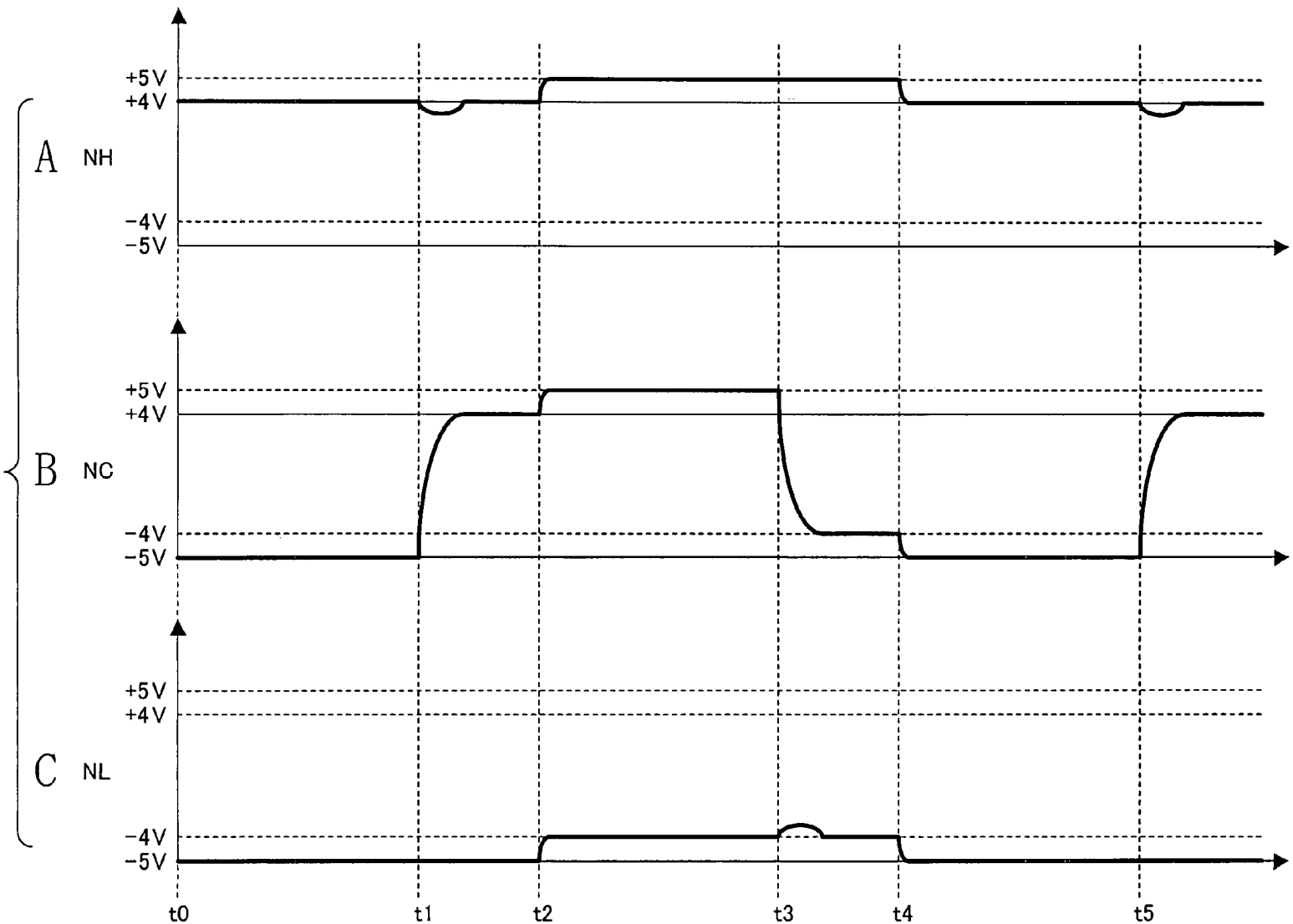
FIG. 4A to FIG. 4C are waveform diagrams showing an example of potential transitions at nodes NH, NC and NL.

In the period t0-t1, the timing control section 11 keeps the control signals S1, S3 and S6 at "L level" and the control signals S2, S4 and S5 at "H level". Since the switch transistors SW2 and SW4 are on, the driving voltage VCOML (−5 V) is supplied to the node NC from the selector section 102L via the nodes N102L and NL. Therefore, the potentials at the nodes N102L, NL and NC are all "−5 V" (FIG. 4B and FIG. 4C). Since the switch transistor SW5 is on, the specified voltage VSETH is supplied to the node NH from the specified voltage supply node N103H. Therefore, the potential at the node NH is "+4 V" (FIG. 4A). Since the driving voltage VCOMH is supplied from the selector section 102H to the node N102H, the potential at the node N102H is "+5 V".

At time t1, the timing control section 11 brings the control signal S3 to "H level" and the control signal S4 to "L level". Since the switch transistor SW5 is on and the switch transistor SW3 is turned on, the node NC is connected to the specified voltage supply node N103H via the node NH. Therefore, the potential at the node NC changes from "−5 V" to "+4 V" (FIG. 4B). The potential at the node NH also changes. However, since the impedance of the specified voltage VSETH supplied from the specified voltage supply node N103H to the node NH is lower than that of the driving voltage VCOML supplied from the selector section 102L to the node NC, the change in the potential at the node NH is smaller than the change in the potential at the node NC. Thus, the potential at the node NH stays constant at the voltage value (+4 V) of the specified voltage VSETH (FIG. 4A). Since the switch transistor SW1 remains off, the potential at the node N102H remains to be "+5 V". Since the switch transistor SW2 is on and the switch transistor SW4 is turned off, the driving voltage VCOML (−5 V) is supplied to the node NL from the selector section 102L via the node N101L. Therefore, the potentials at the nodes N102L and NL both remain to be "−5 V".

At time t2, the timing control section 11 brings the control signals S1 and S6 to "H level" and the control signals S2 and S5 to "L level". Since the switch transistor SW3 is on and the switch transistor SW1 is turned on, the selector section 102H is connected to the node NC via the nodes N102H and NH. Therefore, the potentials at the nodes NH and NC both change from "+4 V" to "+5 V" (FIG. 4A and FIG. 4B). Since the impedance of the driving voltage VCOMH supplied from the selector section 102H to the node N102H is higher than that of the specified voltage VSETH supplied from the specified voltage supply node N103H to the node NH, the potential at the node N102H may possibly change. However, the potential at the node N102H will not decrease below the voltage value (+4 V) of the specified voltage VSETH. Since the switch transistor SW6 is turned on, the specified voltage supply node N103L is connected to the node NL. Therefore, the potential at the node NL changes from "−5 V" to "−4 V" (FIG. 4C). Since the switch transistor SW4 is off, the potential at the node N102L remains to be "−5 V".

At time t3, the timing control section 11 brings the control signal S3 to "L level" and the control signal S4 to "H level". Since the switch transistor SW6 is on and the switch transistor SW4 is turned on, the node NC is connected to the specified voltage supply node N103L via the node NH. Therefore, the potential at the node NC changes from "+5 V" to "−4 V" (FIG. 4B). The potential at the node NL also changes. However, since the impedance of the specified voltage VSETL supplied from the specified voltage supply node N103L to the node NL is lower than that of the driving voltage VCOMH supplied from the selector section 102H to the node NC, the change in the potential at the node NL is smaller than the change in the potential at the node NC. Thus, the potential at the node NL stays constant at the voltage value (−4 V) of the specified voltage VSETL (FIG. 4C). Since the switch transistor SW1 is on and the switch transistor SW3 is turned off, the driving voltage VCOMH (+5 V) is supplied to the node NH from the selector section 102H via the node N101H. Therefore, the potentials at the nodes N102H and NH both remain to be "+5 V".

At time t4, the timing control section 11 brings the control signals S1 and S6 to "L level" and the control signals S2 and S5 to "H level". Since the switch transistor SW4 is on and the switch transistor SW2 is turned on, the selector section 102L is connected to the node NC via the nodes N102L and NL. Therefore, the potentials at the nodes NL and NC both change from "−4 V" to "−5 V" (FIG. 4B and FIG. 4C). Since the impedance of the driving voltage VCOML supplied from the selector section 102L to the node N102L is higher than that of the specified voltage VSETL supplied from the specified voltage supply node N103L to the node NL, the potential at the node N102L may possibly change. However, the potential at the node N102L will not increase above the voltage value (−4 V) of the specified voltage VSETL. Since the switch transistor SW5 is turned on, the specified voltage supply node N103H is connected to the node NH. Therefore, the potential at the node NH changes from "+5 V" to "+4 V" (FIG. 4A). Since the switch transistor SW3 is off, the potential at the node N102H remains to be "+5 V".

At time t5, the operation is similar to that at time t2.

As described above, since the specified voltage VSETH of a low impedance is supplied from the specified voltage supply node N103H to the node NH when the switch transistor SW3 transitions from off to on, the potential at the node NH can stay constant at the voltage value of the specified voltage VSETH. Since the specified voltage VSETL of a low impedance is supplied from the specified voltage supply node N103L to the node NH when the switch transistor SW4 transitions from off to on, the potential at the node NL can stay constant at the voltage value of the specified voltage VSETL.

Moreover, since the specified voltage VSETH satisfies the following relationship:

$$(\text{reference voltage VSSH}) \leqq (\text{specified voltage VSETH}) \leqq (\text{reference voltage VREFH}),$$

the potential difference across a selection transistor included in the selector section 102H can be made smaller than "(reference voltage VREFH)−(reference voltage VREFL)".

Similarly, since the specified voltage VSETL satisfies the following relationship:

$$(\text{reference voltage VREFL}) \leqq (\text{specified voltage VSETL}) \leqq (\text{reference voltage VSSL}),$$

the potential difference across a selection transistor included in the selector section 102L can be made smaller than "(reference voltage VREFH)−(reference voltage VREFL)".

Breakdown Voltage of Transistor

In the operation described above, the potential difference between the node NH and the node NC and that between the node NL and the node NC are about 9 V at maximum. The potential difference between the node N102H and the node NH, that between the node N102L and the node NL, that between the specified voltage supply node N103H and the node NH and that between the specified voltage supply node N103L and the node NL are about 1 V at maximum. Thus, the breakdown voltage of the switch transistors SW1, SW2, SW5 and SW6 can be made lower than that of the switch transistors SW3 and SW4 (the absolute maximum rating of the switch transistors SW1, SW2, SW5 and SW6 can be decreased).

Since the potential at the node NH can stay constant at "+5 V", the absolute maximum rating of a selection transistor included in the selector section 102H does not have to be higher than 10 V ((reference voltage VREFH)−(reference voltage VREFL)) as long as it is higher than 5 V (voltage value of the control signal Sa). Thus, the breakdown voltage of the selection transistors in the selector section 102H can be decreased.

Similarly, since the potential at the node NL can stay constant at "−5 V", the absolute maximum rating of a selection transistor included in the selector section 102L does not have to be higher than 10 V ((reference voltage VREFH)−(reference voltage VREFL)) as long as it is higher than 5 V (voltage value of the control signal Sb). Thus, the breakdown voltage of the selection transistors in the selector section 102L can be decreased.

Effects

Figure 12:
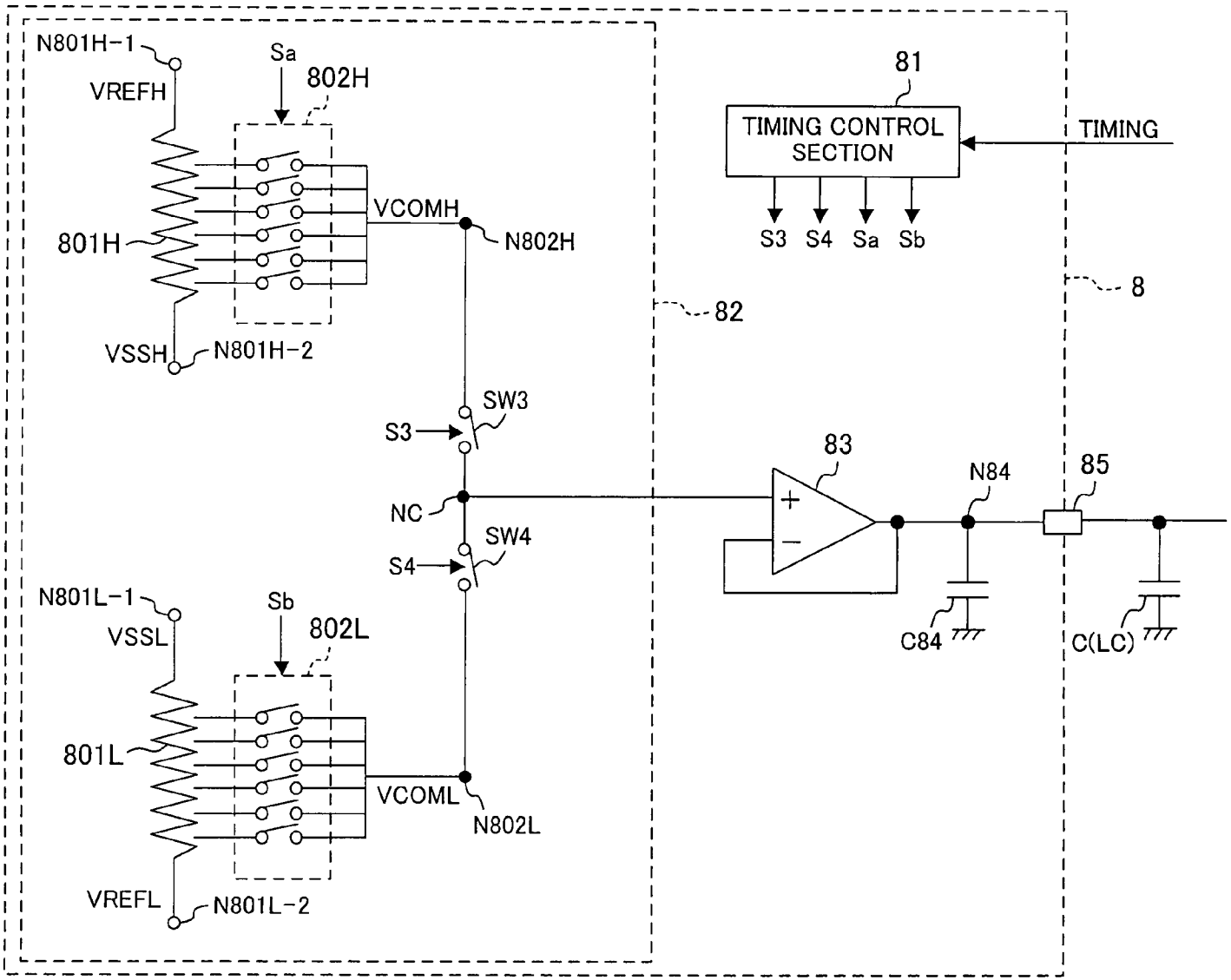
FIG. 12 PRIOR ART
FIG. 12 shows a general configuration of a conventional driving voltage generation device.

As described above, in the driving voltage generation device 1 of the present embodiment, the selection transistors included in the selector section 102H and the selector section 102L can be low-voltage transistors, as compared with the conventional driving voltage generation device shown in FIG. 12. Therefore, the circuit-scale can be reduced.

Moreover, by reducing the breakdown voltage of the selection transistors included in the selector section 102H (102L), it is possible to reduce the amount of time required before the potential at the node NH (NL) becomes stable at the voltage value of the supply voltage selected by the selector section 102H (102L). Thus, it is possible to reduce the amount of time before the potential of the driving voltage VCOMH (VCOML) becomes stable.

Second Embodiment

Generation Configuration

Figure 5:
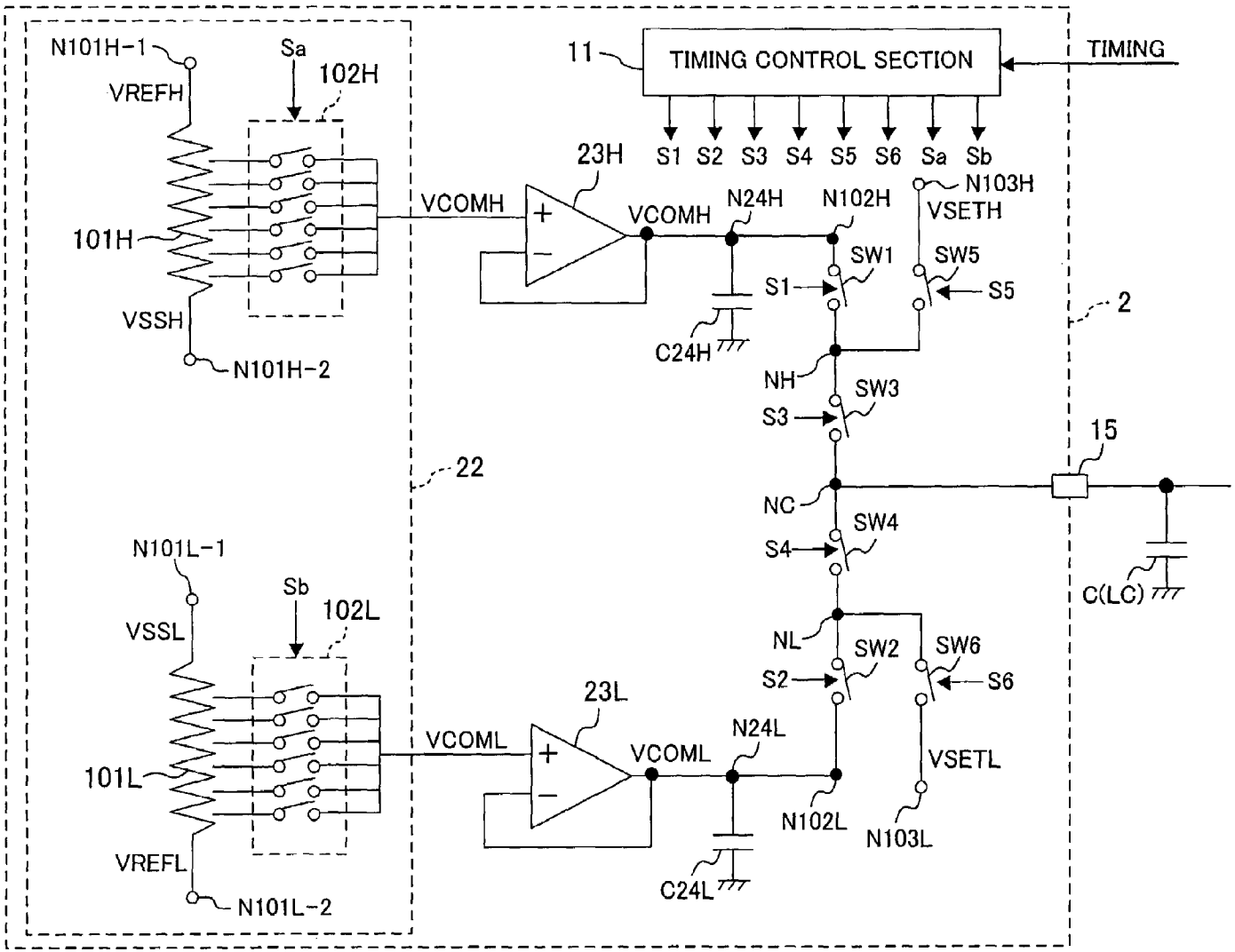
FIG. 5 shows a general configuration of a driving voltage generation device according to a second embodiment of the present invention.

FIG. 5 shows a general configuration of a driving voltage generation device 2 according to a second embodiment of the present invention. The device 2 includes a VCOM voltage generation section 22, a VCOMH operational amplifier 23H, a VCOML operational amplifier 23L and smoothing capacitors C24H and C24L, instead of the VCOM voltage generation section 12, the VCOM operational amplifier 13 and the smoothing capacitor C14 shown in FIG. 1. Moreover, the driving voltage generation device 2 includes the switch transistors SW1 to SW6 shown in FIG. 1.

The VCOM voltage generation section 22 generates the driving voltages VCOMH and VCOML according to the control signals Sa and Sb output from the timing control section 11.

The VCOMH operational amplifier 23H outputs the driving voltage VCOMH generated by the VCOM voltage generation section 22 to the switch transistor SW1. The VCOML operational amplifier 23L outputs the driving voltage VCOML generated by the VCOM voltage generation section 22 to the switch transistor SW2.

The smoothing capacitor C24H is provided for smoothing the fluctuations in the output of the VCOMH operational amplifier 23H, and is connected between a node N24H (a node between the VCOMH operational amplifier 23H and the switch transistor SW1) and a ground node. The smoothing capacitor C24L is provided for smoothing the fluctuations in the output of the VCOML operational amplifier 23L, and is connected between a node N24L (a node between the VCOML operational amplifier 23L and the switch transistor SW2) and a ground node.

The switch transistors SW1 to SW4 are connected in series between the node N24H and the node N24L. How the switch transistors SW1 to SW6 are connected with respect to one another is as shown in FIG. 1.

The output terminal 15 is connected to the interconnection node NC between the switch transistor SW3 and the switch transistor SW4.

Internal Configuration of VCOM Voltage Generation Section 22

The VCOM voltage generation section 22 shown in FIG. 5 includes the ladder resistors 101H and 101L and the selector sections 102H and 102L shown in FIG. 1. How the ladder resistor 101H and the selector section 102H are connected with respect to each other and how the ladder resistor 101L and the selector section 102L are connected with respect to each other are as shown in FIG. 1. The supply voltage selected by the selector section 102H is supplied to the VCOMH operational amplifier 23H as the driving voltage VCOMH. The supply voltage selected by the selector section 102L is supplied to the VCOML operational amplifier 23L as the driving voltage VCOML.

Operation

The operation of the driving voltage generation device 2 shown in FIG. 5 will be described.

First, the timing control section 11 outputs the control signals Sa and Sb, as in the first embodiment.

Then, in the VCOM voltage generation section 22, the selector section 102H selects one of the plurality of supply voltages generated by the ladder resistor 101H according to the control signal Sa from the timing control section 11, as in the first embodiment. The supply voltage selected by the selector section 102H is output as the driving voltage VCOMH. The selector section 102L selects one of the plurality of supply voltages generated by the ladder resistor 101L according to the control signal Sb from the timing control section 11, as in the first embodiment. The supply voltage selected by the selector section 102L is output as the driving voltage VCOML.

Then, the VCOMH operational amplifier 23H outputs the driving voltage VCOMH from the selector section 102H to the switch transistor SW1. The VCOML operational amplifier 23L outputs the driving voltage VCOML from the selector section 102L to the switch transistor SW2.

Thereafter, the switch transistors SW1 to SW6 operate as described above in the first embodiment. Thus, the driving voltage VCOMH output from the VCONM operational amplifier 23H to the switch transistor SW1 and the driving voltage VCOML output from the VCOML operational amplifier 23L to the switch transistor SW2 are alternately supplied to the output terminal 15'.

Effects

As described above, since the potential at the node N24H can stay constant at "+5 V", low-voltage transistors can be used in the VCOMH operational amplifier 23H. Since the potential at the node N24L can stay constant at "−5 V", low-voltage transistors can be used in the VCOML operational amplifier 23L. Thus, it is possible to reduce the circuit scale. Moreover, it is possible to increase the driving power (response speed) of the VCOMH operational amplifier 23H and the VCOML operational amplifier 23L.

Third Embodiment

General Configuration

Figure 6:
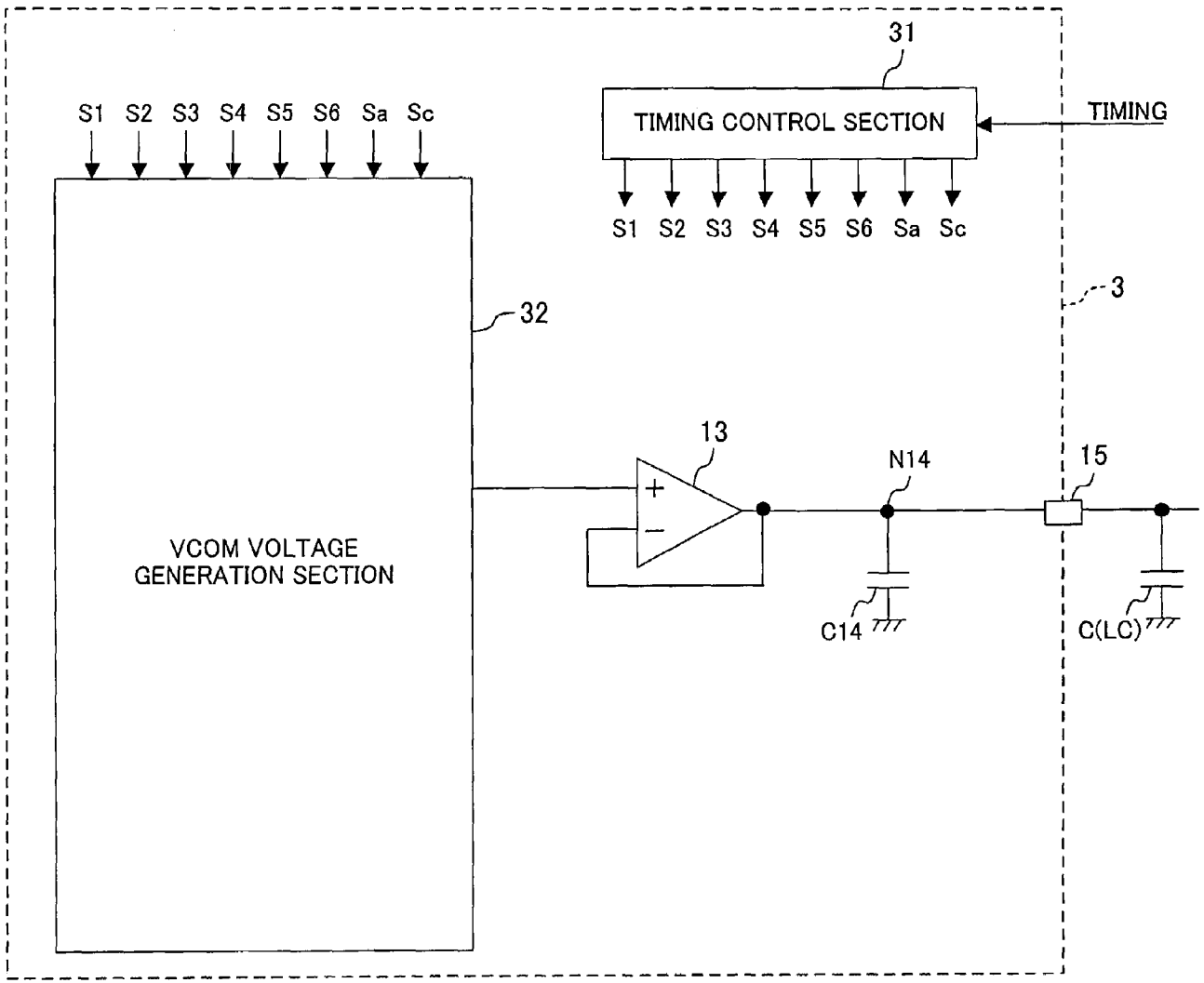
FIG. 6 shows a general configuration of a driving voltage generation device according to a third embodiment of the present invention.

FIG. 6 shows a general configuration of a driving voltage generation device 3 according to a third embodiment of the present invention. The device 3 includes a timing control section 31 and a VCOM voltage generation section 32, instead of the timing control section 11 and the VCOM voltage generation section 12 shown in FIG. 1. Other than this, the configuration is similar to that shown in FIG. 1.

The timing control section 31 uses the control signal Sa and the amplitude information Sc to control the voltage values of the driving voltages VCOMH and VCOML output by the VCOM voltage generation section 32. The amplitude information Sc represents a voltage (amplitude voltage VREFM)

having a voltage value according to the potential difference between the driving voltage VCOMH and the driving voltage VCOML to be generated by the VCOM voltage generation section 32. The timing control section 31 outputs the control signals S1 to S6 according to the timing signal TIMING from outside.

The VCOM voltage generation section 32 generates the driving voltages VCOMH and VCOML according to the control signal Sa and the amplitude information Sc output from the timing control section 31. The VCOM voltage generation section 32 outputs one of the driving voltages VCOMH and VCOML according to the control signals S1 to S6 output from the timing control section 31.

Internal Configuration of VCOM Voltage Generation Section 32

Figure 7:
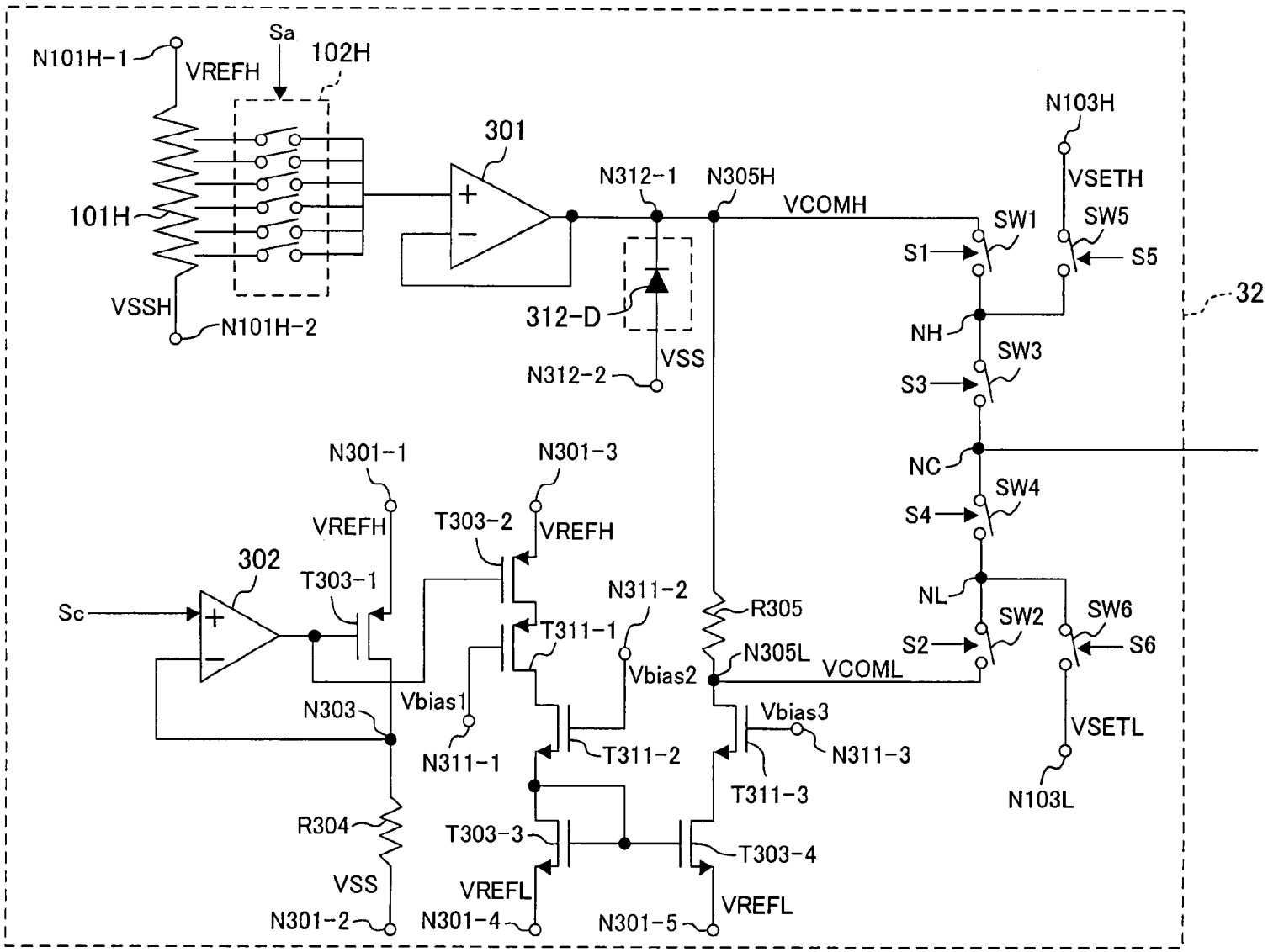
FIG. 7 shows an internal configuration of a VCOM voltage generation section shown in FIG. 6.

FIG. 7 shows an internal configuration of the VCOM voltage generation section 32 shown in FIG. 6. The VCOM voltage generation section 32 includes a supply operational amplifier 301, a selection operational amplifier 302, supply transistors T303-1 to T303-4, resistors R304 and R305, clamp transistors T311-1 to T311-3 and a diode 312-D, instead of the ladder resistor 101L and the selector section 102L shown in FIG. 1. Other than this, the configuration is similar to that of the VCOM voltage generation section 12 shown in FIG. 1.

The supply operational amplifier 301 is a voltage follower circuit, and is connected between the selector section 102H and the switch transistor SW1.

The selection operational amplifier 302, the supply transistor T303-1 and the resistor R304 together form a voltage-current conversion circuit. The selection operational amplifier 302 includes an output terminal connected to the gate of the supply transistor T303-1, an input terminal connected to an interconnection node N303 between the supply transistor T303-1 and the resistor R304, and another input terminal at which it receives the amplitude information Sc (amplitude voltage VREFM) from the timing control section 31. The supply transistor T303-1 and the resistor R304 are connected in series between a reference node N301-1 receiving the reference voltage VREFH and a reference node N301-2 receiving the reference voltage VSS.

The supply transistor T303-2, the clamp transistors T311-1 and T311-2 and the supply transistor T303-3 are connected in series between a reference node N301-3 receiving the reference voltage VREFH and a reference node N301-4 receiving the reference voltage VREFL. The supply transistor T303-2 is connected between a reference node N301-3 and the clamp transistor T311-1, and the gate thereof is connected to the gate of the supply transistor T303-1. The clamp transistor T311-1 is connected between the supply transistor T303-2 and the clamp transistor T311-2, and the gate thereof is connected to a bias voltage supply node N311-1 receiving a bias voltage Vbias1. The clamp transistor T311-2 is connected between the clamp transistor T311-1 and the supply transistor T303-3, and the gate thereof is connected to a bias voltage supply node N311-2 receiving a bias voltage Vbias2. The supply transistor T303-3 is connected between the clamp transistor T311-2 and the reference node N301-4, and the gate thereof is connected to the drain thereof.

The resistor R305, the clamp transistor T311-3 and the supply transistor T303-4 are connected in series between a node N305H (a node between the supply operational amplifier 301 and the switch transistor SW1) and a reference node N301-5 receiving the reference voltage VREFL. The resistor R305 is connected between the node N305H and the clamp transistor T311-3. The clamp transistor T311-3 is connected between the resistor R305 and the supply transistor T303-4, and the gate thereof is connected to a bias voltage supply node N311-3 receiving a bias voltage Vbias3. The supply transistor T303-4 is connected between the clamp transistor T311-3 and a reference node N301-5 receiving the reference voltage VREFL, and the gate thereof is connected to the gate of the supply transistor T303-3.

The switch transistors SW1 to SW4 are connected in series between the node N305H and a node N305L. The node N305L is an interconnection node between the resistor R305 and the clamp transistor T311-3. How the switch transistors SW1 to SW6 are connected with respect to one another is as shown in FIG. 1.

The diode 312-D is a clamp circuit provided for restricting the potential at the node N305H to be higher than the potential at a reference node N312-2 (reference voltage VSS), and is connected between a node N312-1 (a node between the supply operational amplifier 301 and the switch transistor SW1) and a node N312-2 receiving the reference voltage VSS.

Herein, the reference voltage VSS, and the voltage value of the amplitude information Sc (amplitude voltage VREFM) satisfy the following relationships:

(reference voltage VREFL)≦(reference voltage VSS)≦ (reference voltage VREFH); and (reference voltage VSS)≦(amplitude voltage VREFM)≦(reference voltage VREFH).

Operation

Next, the operation of the VCOM voltage generation section 32 shown in FIG. 7 will be described. Herein, the voltage value of the reference voltage VREFH is "+5 V", the voltage values of the reference voltages VSSH and VSS are "0 V", and the voltage value of the reference voltage VREFL is "−5 V".

The selector section 102H selects one of the plurality of supply voltages generated by the ladder resistor 101H according to the control signal Sa from the timing control section 31. The supply operational amplifier 301 outputs the driving voltage VCOMH selected by the selector section 102H to the switch transistor SW1.

The selection operational amplifier 302 receives the amplitude information Sc from the timing control section 31. A supply current IrefM having a current value according to the voltage value of the amplitude information Sc (amplitude voltage VREFM) flows through the supply transistor T303-1 and the resistor R304. The supply current IrefM satisfies Expression 1 below.

(supply current IrefM)=(amplitude voltage VREFM)/(resistance R304) Expression 1

Then, the supply transistor T303-2 receives at the gate thereof the gate voltage generated at the gate of the supply transistor T303-1. Thus, the supply current IrefM flows through the supply transistor T303-2, the clamp transistors T311-1 and T311-2 and the supply transistor T303-3.

Then, due to the presence of the current mirror circuit formed by the supply transistors T303-3 and T303-4, the supply current IrefM flowing through the supply transistor T303-3 flows through the supply transistor T303-4. Thus, the driving voltage VCOML is generated at the node N305L. The driving voltage VCOML satisfies Expression 2 below.

(driving voltage VCOML)=(driving voltage VCOMH)−(supply current IrefM)×(resistance R305) Expression 2

Based on Expressions 1 and 2 above, the voltage value of the driving voltage VCOML generated at the node N305L is as shown in Expression 3 below.

(driving voltage VCOML)=(driving voltage VCOMH)−(amplitude voltage VREFM)×(resistance R305)/(resistance R304) Expression 3

Thus, the driving voltage VCOMH according to the control signal Sa is supplied from the supply operational amplifier 301 to the switch transistor SW1, and the driving voltage VCOML according to the control signal Sa and the amplitude information Sc is supplied to the switch transistor SW2.

Thereafter, the switch transistors SW1 to SW6 operate as described above in the first embodiment. Thus, the driving voltage VCOMH output from the supply operational amplifier 301 to the node N305H and the driving voltage VCOML generated at the node N305L are alternately output to the VCOM operational amplifier 13 (see FIG. 6).

Function of Clamp Transistor

With the provision of the clamp transistor T311-1, it is possible to adjust the drain voltage of the supply transistor T303-2. Specifically, the drain voltage of the supply transistor T303-2 can be set to "(bias voltage Vbias1)+(gate-source voltage of transistor T311-1)". Therefore, the voltage value of the drain voltage of the supply transistor T303-2 can be made higher than the voltage value of the reference voltage VREFL. Moreover, since the fluctuations of the drain voltage of the supply transistor T303-2 can be made smaller than those in the prior art, it is possible to reduce the influence of the drain voltage dependence.

It is preferred herein that the bias voltage Vbias1 is "0 V" and the gate-source voltage of the clamp transistor T311-1 is equal to, or substantially equal to, "the amplitude voltage VREFM". Then, the drain voltage of the supply transistor T303-2 can be made equal to that of the supply transistor T303-1, whereby it is possible to reduce the influence of the drain voltage dependence.

With the provision of the clamp transistors T311-2 and T311-3, it is possible to adjust the drain voltages of the supply transistors T303-3 and T303-4. Specifically, the drain voltage of the supply transistor T303-3 will not increase above "(bias voltage Vbias2)−(gate-source voltage of transistor T311-2)", and the drain voltage of the supply transistor T303-4 will not increase above "(bias voltage Vbias3)−(gate-source voltage of transistor T311-3)". Therefore, the drain voltages of the supply transistors T303-3 and T303-4 can be made lower than the reference voltage VREFH. Moreover, as with the supply transistor T303-2, it is possible to reduce the influence of the drain voltage dependence with the supply transistors T303-3 and T303-4.

It is preferred herein that the gate-source voltage of the clamp transistor T311-3 is equal to, or substantially equal to, the gate-source voltage of the clamp transistor T311-2, and the bias voltage Vbias2, Vbias3 is equal to, or substantially equal to, "the gate-source voltage of the clamp transistor T311-2 (T311-3)". Then, it is possible to prevent the drain voltages of the supply transistors T303-3 and T303-4 from becoming higher than "0 V".

Effects

Figure 13:
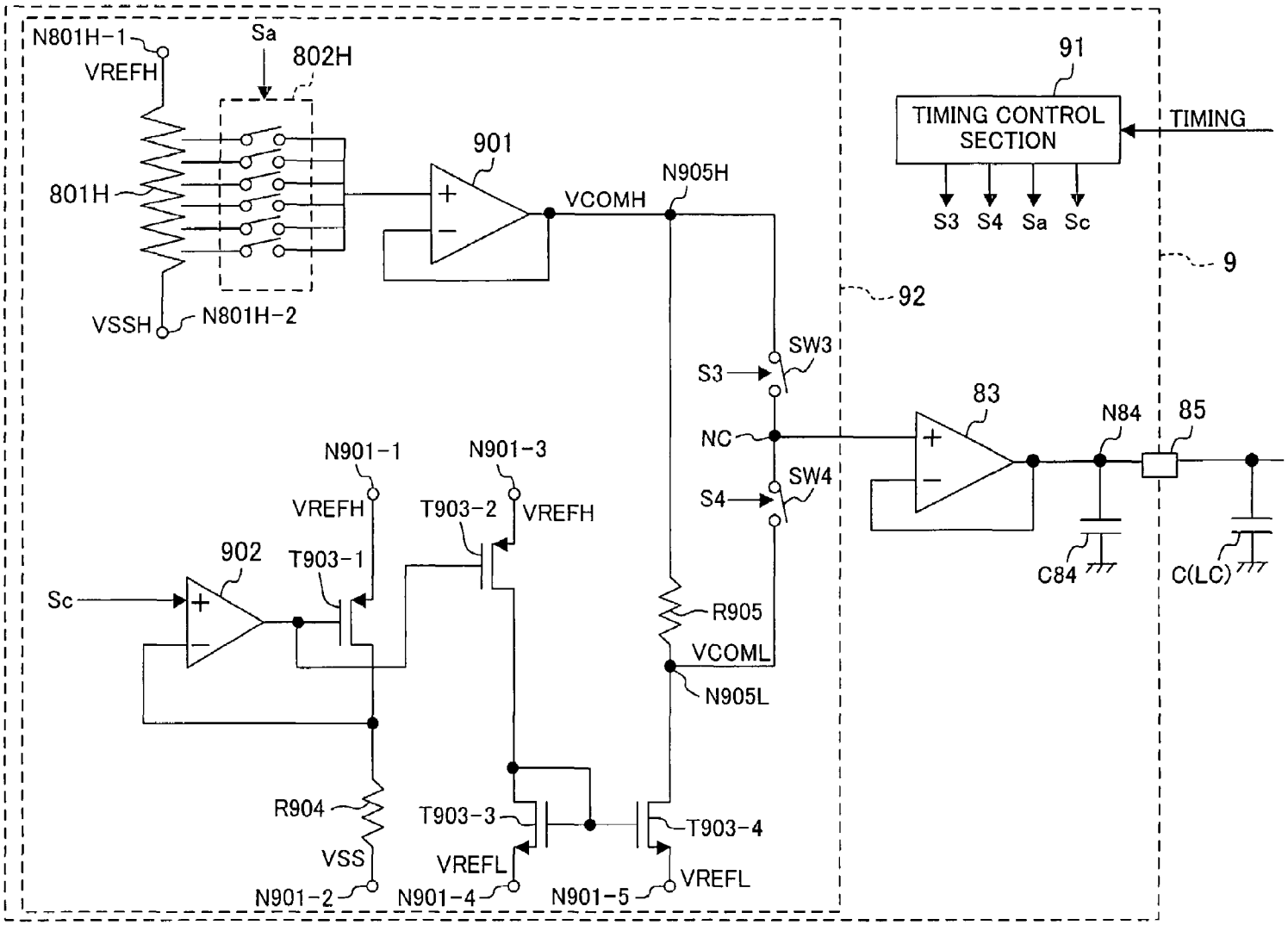
FIG. 13 PRIOR ART
FIG. 13 shows a general configuration of a conventional driving voltage generation device.

As described above, since the potential at the node N305L can stay constant at "−5 V" with the switches SW1 to SW6 operating appropriately, the potential difference across the supply transistor T303-4 can be made smaller than "(reference voltage VREFH)−(reference voltage VREFL)". The potential difference across each of the supply transistors T303-2 and T303-3 can also be made smaller than "(reference voltage VREFH)−(reference voltage VREFL)". The potential difference across each of the clamp transistors T311-1 to T311-3 can also be made smaller than "(reference voltage VREFH)−(reference voltage VREFL)". Thus, as compared with the conventional driving voltage generation device shown in FIG. 13, the breakdown voltage of the supply transistors T303-1 to T303-4 can be reduced, whereby it is possible to reduce the circuit scale.

By reducing the breakdown voltages of the supply transistors T303-1 to T303-4 and the clamp transistors T311-1 to T311-3, it is possible to reduce the process variation that each of these transistors has. Therefore, it is possible to reduce the variation of current characteristic of the current mirror circuit formed by the supply transistors T303-1 and T303-2 and that of the current mirror circuit formed by the supply transistors T303-3 and T303-4. Moreover, it is possible to reduce the influence of the drain voltage dependence of the supply transistors T303-1 to T303-4 and the clamp transistors T311-1 to T311-3. Thus, it is possible to accurately generate the driving voltage VCOML according to the control signal Sa and the amplitude information Sc.

Note that the voltage value of the bias voltage Vbias1 may be any suitable value such that: the clamp transistor T311-1 and the supply transistor T303-2 operate in the saturation region; each of the gate-source voltage Vgs, the drain-source voltage Vds and the back gate-source voltage Vbs of the clamp transistor T311-1 is less than or equal to the absolute maximum rating of the clamp transistor T311-1; and each of the gate-source voltage Vgs, the drain-source voltage Vds and the back gate-source voltage Vbs of the supply transistor T303-2 is less than or equal to the absolute maximum rating of the supply transistor T303-2. Then, it is possible to prevent the clamp transistor T311-1 and the supply transistor T303-2 from being broken by the bias voltage Vbias1.

The voltage value of the bias voltage Vbias2 may be any suitable value such that: the clamp transistor T311-2 and the supply transistor T303-3 operate in the saturation region; each of the gate-source voltage Vgs, the drain-source voltage Vds and the back gate-source voltage Vbs of the clamp transistor T311-2 is less than or equal to the absolute maximum rating of the clamp transistor T311-2; and each of the gate-source voltage Vgs, the drain-source voltage Vds and the back gate-source voltage Vbs of the supply transistor T303-3 is less than or equal to the absolute maximum rating of the supply transistor T303-3.

The voltage value of the bias voltage Vbias3 may be any suitable value such that: the clamp transistor T311-3 and the supply transistor T303-4 operate in the saturation region; each of the gate-source voltage Vgs, the drain-source voltage Vds and the back gate-source voltage Vbs of the clamp transistor T311-3 is less than or equal to the absolute maximum rating of the clamp transistor T311-3; and each of the gate-source voltage Vgs, the drain-source voltage Vds and the back gate-source voltage Vbs of the supply transistor T303-4 is less than or equal to the absolute maximum rating of the supply transistor T303-4.

Figure 8B:
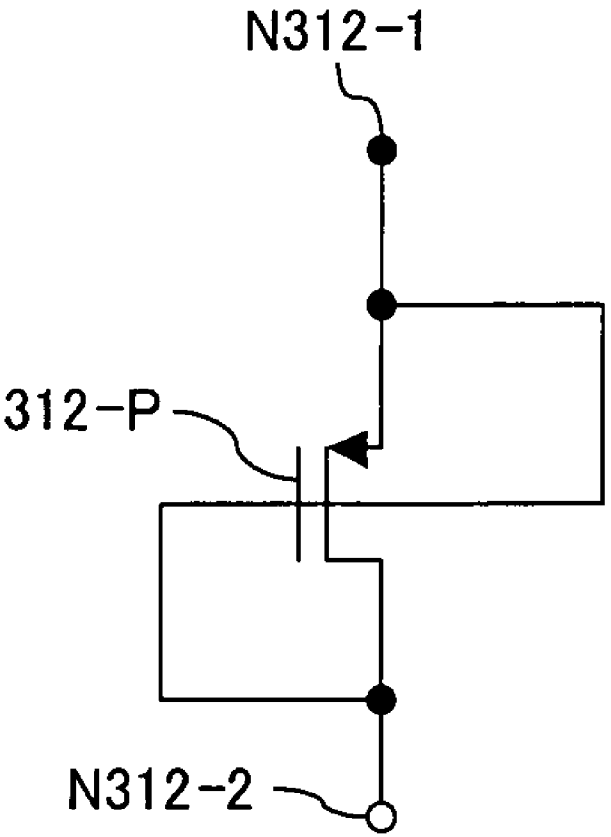
FIG. 8A and FIG. 8B each show an exemplary clamp circuit used in FIG. 6.
Figure 8A:
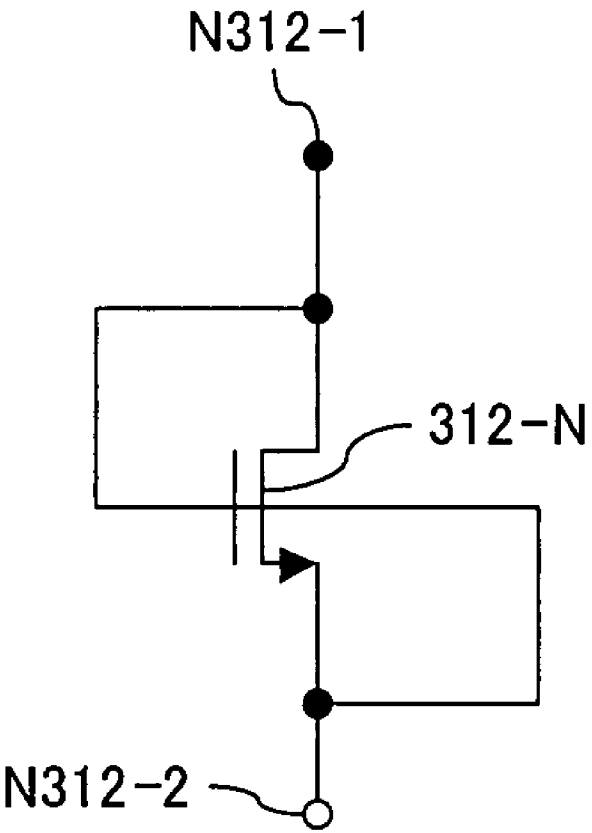

Similar effects can be obtained also when a transistor 312-N as shown in FIG. 8A or a transistor 312-P as shown in FIG. 8B is used instead of the diode 312-D.

Depending on the voltage values of the reference voltages VREFH and VREFL, a clamp transistors may be added between the supply transistor T303-2 and the supply transistor T303-3 and between the resistor R305 and the supply transistor T303-3. Then, low-voltage transistors can be used as the supply transistors and the clamp transistors even if the potential difference between the reference voltage VREFH and the reference voltage VREFL is large.

While the supply current generation section (the selection operational amplifier 302, the resistors R304 and R305, the supply transistors T303-1 to T303-4 and the clamp transistors T311-1 to T311-3) is used instead of the ladder resistor 101L and the selector section 102L in the present embodiment, the supply current generation section may be used instead of the ladder resistor 101H and the selector section 102H. In such a case, P-channel transistors (the supply transistor T303-1, etc.) can be replaced with N-channel transistors and N-channel transistors (the supply transistor T303-3, etc.) can be replaced with P-channel transistors, for example.

Fourth Embodiment

General Configuration

Figure 9:
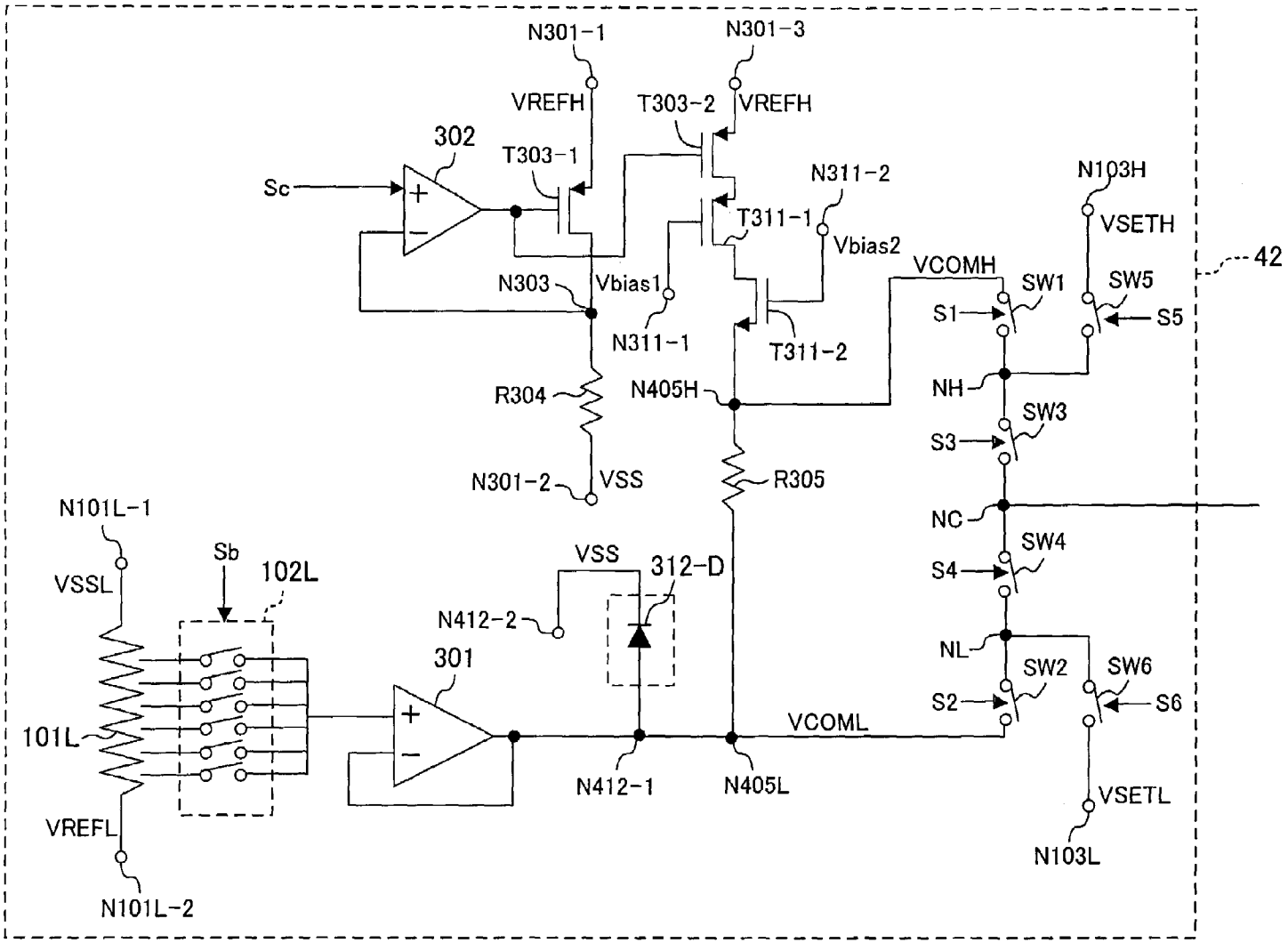
FIG. 9 shows an internal configuration of a VCOM voltage generation section used in a fourth embodiment of the present invention.

A driving voltage generation device 4 according to a fourth embodiment of the present invention includes a VCOM voltage generation section 42 as shown in FIG. 9, instead of the VCOM voltage generation section 32 shown in FIG. 6. Other than this, the configuration is similar to that shown in FIG. 6. The timing control section 31 uses the control signal Sb and the amplitude information Sc to control the voltage values of the driving voltages VCOMH and VCOML output by the VCOM voltage generation section 42.

Internal Configuration of VCOM Voltage Generation Section 42

The VCOM voltage generation section 42 shown in FIG. 9 includes the supply operational amplifier 301, the selection operational amplifier 302, the supply transistors T303-1 and T303-2, the clamp transistors T311-1 and T311-2, the resistor R305 and the diode 312-D shown in FIG. 7, instead of the ladder resistor 101H and the selector section 102H shown in FIG. 1. Other than this, the configuration is similar to that of the VCOM voltage generation section 12 shown in FIG. 1.

The supply operational amplifier 301 is connected between the selector section 102L and the switch transistor SW2.

How the selection operational amplifier 302, the supply transistors T303-1 and T303-2, the resistor R304 and the clamp transistors T311-1 and T311-2 are connected with respect to one-another is as shown in FIG. 7. The supply transistor T303-2, the clamp transistors T311-1 and T311-2 and the resistor R305 are connected in series between the reference node N301-3 and a node N405L. The node N405L is present between the supply operational amplifier 301 and the switch transistor SW2. The resistor R305 is connected between the clamp transistor T311-2 and the node N405L.

The diode 312-D is connected between a node N412-1 (a node between the supply operational amplifier 301 and the switch transistor SW2) and a reference node N412-2 receiving the reference voltage VSS.

The switch transistors SW1 to SW4 are connected between an interconnection node N405H (a node between the clamp transistor T311-2 and the resistor R305) and the node N405L.

How the switch transistors SW1 to SW6 are connected with respect to one another is as shown in FIG. 1.

Operation

Next, the operation of the VCOM voltage generation section 42 shown in FIG. 9 will be described.

The selector section 102L selects one of the supply voltages generated by the ladder resistor 101L according to the control signal Sb from the timing control section 31. The supply operational amplifier 301 outputs the driving voltage VCOML selected by the selector section 102L to the switch transistor SW2.

The selection operational amplifier 302, the supply transistors T303-1 and T303-2 and the clamp transistors T311-1 and T311-2 operate as in the third embodiment. Therefore, the voltage value of the driving voltage VCOMH generated at the node N405H is as shown in Expression 4 below.

$$(\text{driving voltage VCOMH}) = (\text{driving voltage VCOML}) + (\text{amplitude voltage VREFM}) \times (\text{resistance R305})/(\text{resistance R304}) \qquad \text{Expression 4}$$

Thus, the driving voltage VCOMH according to the control signal Sb and the amplitude information Sc is supplied to the switch transistor SW1, and the driving voltage VCOML according to the control signal Sb is supplied from the supply operational amplifier 301 to the switch transistor SW2.

Thereafter, the switch transistors SW1 to SW6 operate as described above in the first embodiment. Thus, the driving voltage VCOMH generated at the node N405H and the driving voltage VCOML output from the supply operational amplifier 301 to the node N405L are alternately output to the VCOM operational amplifier 13 (see FIG. 6).

Effects

As described above, since the potential at the node N405H can stay constant at "+5 V", the potential difference across the supply transistor T303-2 can be made smaller than "(reference voltage VREFH)−(reference voltage VREFL)". The potential difference across each of the clamp transistors T311-1 and T311-2 can also be made smaller than "(reference voltage VREFH)−(reference voltage VREFL)". Thus, as compared with the conventional driving voltage generation device shown in FIG. 13, the breakdown voltage of the supply transistor T303-2 can be reduced, whereby it is possible to reduce the circuit scale.

Since it is possible to reduce the process variation of the supply transistor T303-1, it is possible to reduce the variation of current characteristic of the supply transistor T303-1. Similar to the supply transistor T303-1, it is possible to reduce the variation of current characteristic of the supply transistor T303-2. Thus, it is possible to accurately generate the driving voltages VCOMH and VCOML according to the control signal Sb and the amplitude information Sc.

Similar effects can be obtained also when the transistor 312-N as shown in FIG. 8A or the transistor 312-P as shown in FIG. 8B is used instead of the diode 312-D.

Fifth Embodiment

General Configuration

Figure 10:
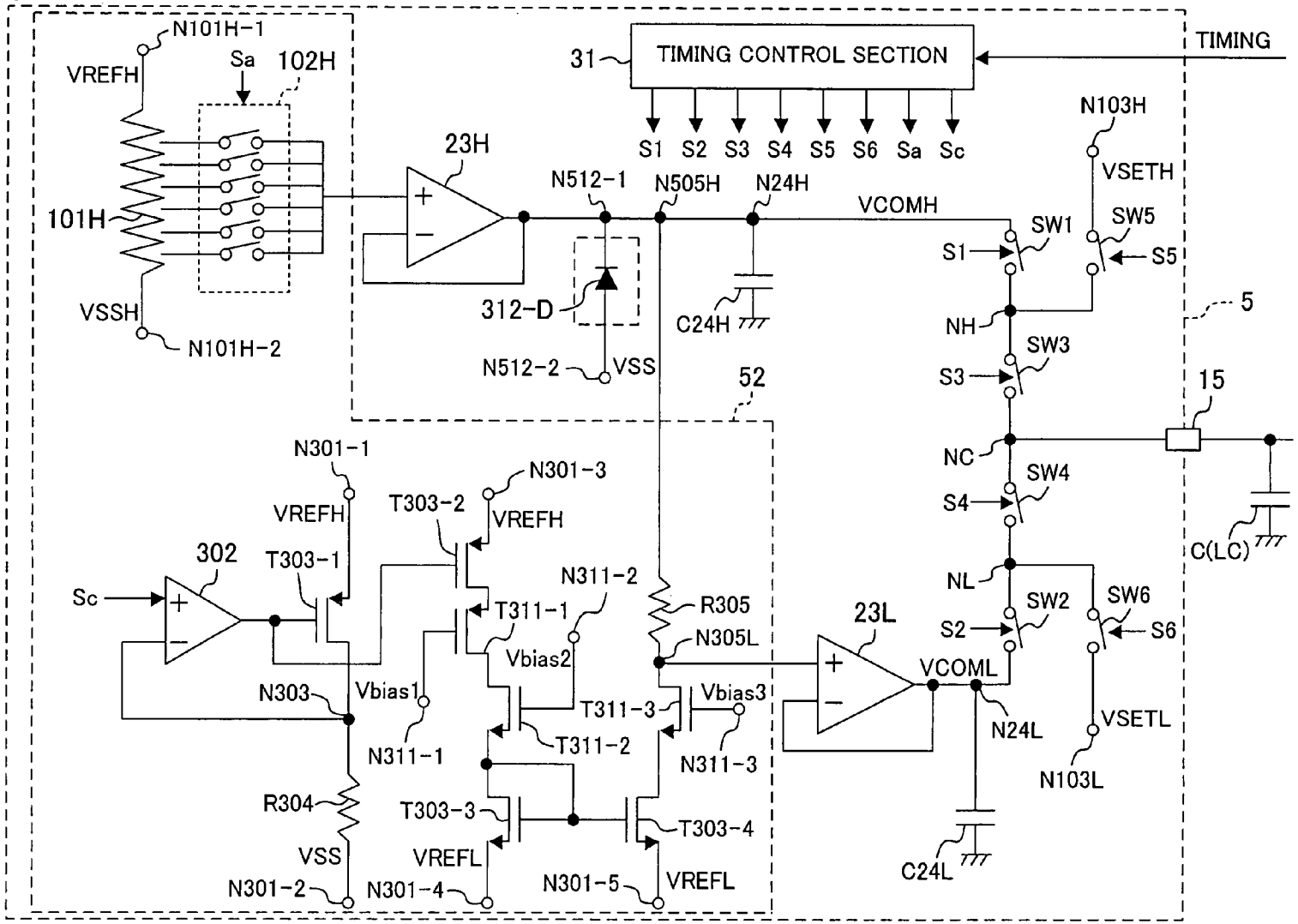
FIG. 10 shows a general configuration of a driving voltage generation device according to a fifth embodiment of the present invention.

FIG. 10 shows a general configuration of a driving voltage generation device 5 according to a fifth embodiment of the present invention. The device 5 includes a VCOM voltage generation section 52, instead of the VCOM voltage generation section 12 shown in FIG. 5. The driving voltage generation device 5 also includes the diode 312-D shown in FIG. 7. The VCOM voltage generation section 52 generates the driving voltages VCOMH and VCOML according to the control signal Sa and the amplitude information Sc from a timing control section 21. The diode 312-D is connected between a node N512-1 (a node between the VCOMH operational amplifier 23H and the switch transistor SW1) and a reference node N512-2 receiving the reference voltage VSS. Other than this, the configuration is similar to that shown in FIG. 5.

VCOM Voltage Generation Section 52

The VCOM voltage generation section 52 shown in FIG. 10 includes the selection operational amplifier 302, the supply transistors T303-1 to T303-4, the resistors R304 and R305 and the clamp transistors T311-1 to T311-3 shown in FIG. 7, instead of the ladder resistor 101L and the selector section 102L shown in FIG. 5. Other than this, the configuration is similar to that shown in FIG. 5.

How the selection operational amplifier 302, the supply transistors T303-1 to T303-4, the resistor R304 and the clamp transistors T311-1 to T311-3 are connected with respect to one another is as shown in FIG. 7. The resistor R305, the clamp transistor T311-3 and the supply transistor T303-4 are connected in series between a node N505H (a node between the VCOMH operational amplifier 23H and the switch transistor SW1) and the reference node N301-5. The interconnection node N305L between the resistor R305 and the clamp transistor T311-3 is connected to the VCOML operational amplifier 23L.

Operation

The operation of the VCOM voltage generation section 52 shown in FIG. 10 will be described.

First, the selector section 102H selects one of the plurality of supply voltages generated by the ladder resistor 101L, as in the second embodiment. Then, the VCOMH operational amplifier 23H outputs the supply voltage selected by the selector section 102H as the driving voltage VCOMH.

The selection operational amplifier 302, the supply transistors T303-1 to T303-4, the resistors R304 and R305 and the clamp transistors T311-1 to T311-3 operate as described above in the third embodiment. Thus, the driving voltage VCOML is generated at the node N305L. Then, the VCOML operational amplifier 23L outputs the driving voltage VCOML generated at the node N305L to the switch transistor SW2.

Thereafter, the switch transistors SW1 to SW6 operate as described above in the second embodiment. Thus, the driving voltage VCOMH output from the VCOMH operational amplifier 23H to the switch transistor SW1 and the driving voltage VCOML output from the VCOML operational amplifier 23L to the switch transistor SW2 are alternately output to the output terminal 15.

Effects

As described above, since the potential at the node N24H can stay constant at "+5 V", low-voltage transistors can be used in the VCOMH operational amplifier 23H. Since the potential at the node N24L can stay constant at "−5 V", low-voltage transistors can be used in the VCOML operational amplifier 23L. Thus, it is possible to reduce the circuit scale. Moreover, it is possible to increase the driving power (response speed) of the VCOMH operational amplifier 23H and the VCOML operational amplifier 23L.

Sixth Embodiment

General Configuration

Figure 11:
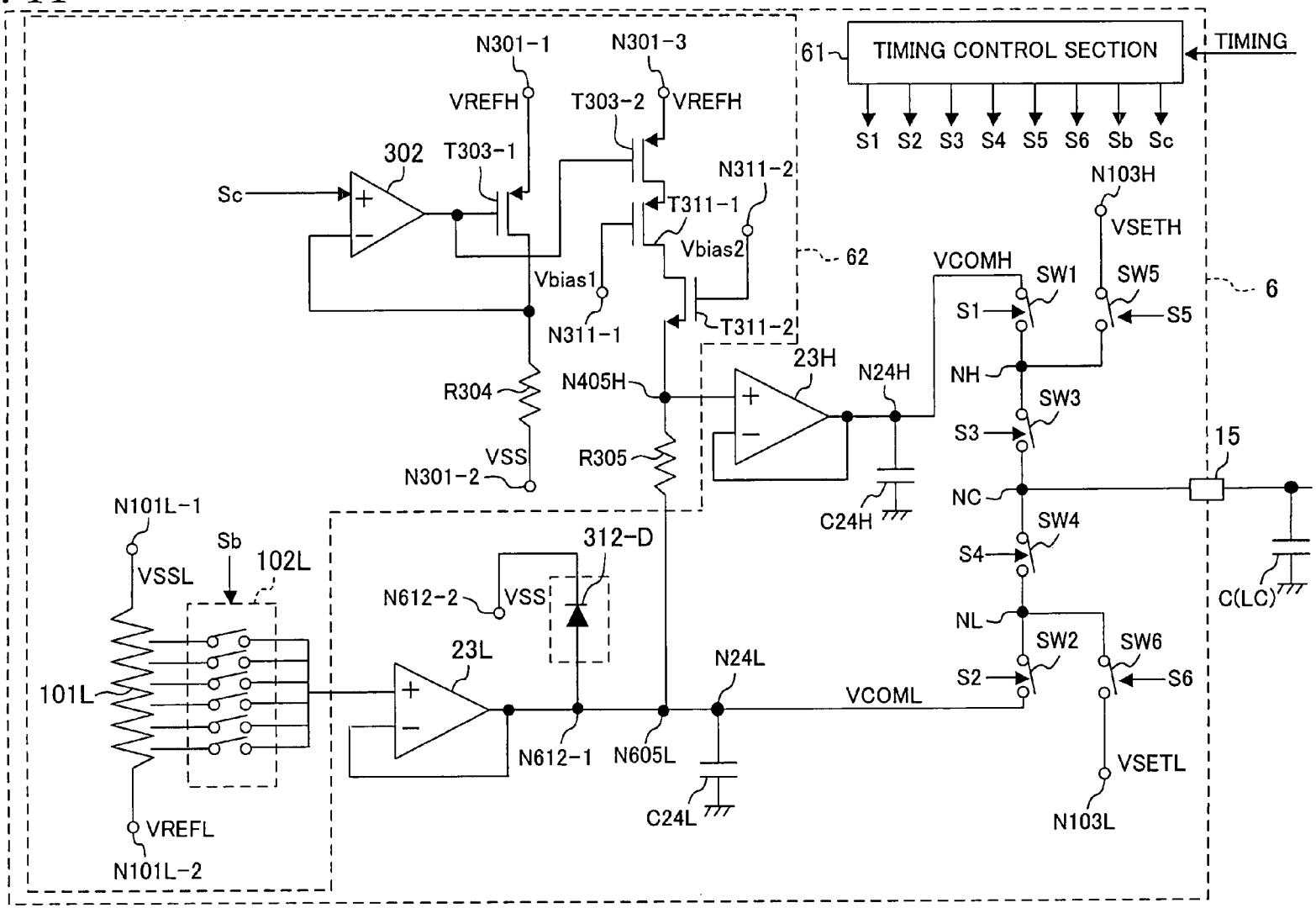
FIG. 11 shows a general configuration of a driving voltage generation device according to a sixth embodiment of the present invention.

FIG. 11 shows a general configuration of a driving voltage generation device 6 according to a sixth embodiment of the present invention. The device 6 includes a timing control section 61 and a VCOM voltage generation section 62, instead of the timing control section 11 and the VCOM voltage generation section 22 shown in FIG. 5. The driving voltage generation device 6 also includes the diode 312-D shown in FIG. 7. The timing control section 61 uses the control signal Sb and the amplitude information Sc to control the voltage values of the driving voltages VCOMH and VCOML output by the VCOM voltage generation section 62. The timing control section 61 outputs the control signals S1 to S6 according to the timing signal TIMING from outside. The VCOM voltage generation section 62 generates the driving voltages VCOMH and VCOML according to the control signal Sb and the amplitude information Sc from the timing control section 61. The diode 312-D is connected between a node N612-1 (a node between the VCOML operational amplifier 23L and the switch transistor SW2) and a reference node N612-2 receiving the reference voltage VSS. Other than this, the configuration is similar to that shown in FIG. 5.

Internal Configuration of VCOM Voltage Generation Section 62

The VCOM voltage generation section 62 shown in FIG. 11 includes the selection operational amplifier 302, the supply transistors T303-1 and T303-2, the resistors R304 and R305 and the clamp transistors T311-1 and T311-2 shown in FIG. 9, instead of the ladder resistor 101H and the selector section 102H shown in FIG. 5. Other than this, the configuration is similar to that shown in FIG. 5.

How the selection operational amplifier 302, the supply transistors T303-1 and T303-2, the resistors R304 and R305 and the clamp transistors T311-1 and T311-2 are connected with respect to one another is as shown in FIG. 9. The supply transistor T303-2, the clamp transistors T311-1 and T311-2 and the resistor R305 are connected in series between a node N605L (a node between the VCOML operational amplifier 23L and the switch transistor SW2) and the reference node N301-3. The interconnection node N405H between the clamp transistor T311-2 and the resistor R305 is connected to a VCOMH operational amplifier 23H.

Operation

The operation of the VCOM voltage generation section 62 shown in FIG. 11 will be described.

First, the selector section 102L selects one of the plurality of supply voltages generated by the ladder resistor 101L, as in the second embodiment. The VCOML operational amplifier 23L outputs the supply voltage selected by the selector section 102L as the driving voltage VCOML.

The selection operational amplifier 302, the supply transistors T303-1 and T303-2, the resistors R304 and R305 and the clamp transistors T311-1 and T311-2 operate as described above in the fourth embodiment. Thus, the driving voltage VCOMH is generated at the node N405H. Then, the VCOMH operational amplifier 23H outputs the driving voltage VCOMH generated at the node N405H to the switch transistor SW1.

Thereafter, the switch transistors SW1 to SW6 operate as described above in the second embodiment. Thus, the driving voltage VCOMH output from the VCOMH operational amplifier 23H to the switch transistor SW1 and the driving voltage VCOML output from the VCOML operational amplifier 23L to the switch transistor SW2 are alternately output to the output terminal 15.

Effects

As described above, since low-voltage transistors can be used in the VCOMH operational amplifier 23H and the VCOML operational amplifier 23L, it is possible to reduce the circuit scale. Moreover, it is possible to increase the driving power (response speed) of the VCOMH operational amplifier 23H and the VCOML operational amplifier 23L.

Specific figures used in the preferred embodiments above are not limiting, and may be replaced with any other suitable figures.

The driving voltage generation device of the present invention is useful in applications such as a driving voltage generation device for driving a liquid crystal display panel by an AC driving method.

What is claimed is:

1. A driving voltage generation device, comprising:

a first selector section for receiving a plurality of first supply voltages and outputting one of the first supply voltages;

a second selector section for receiving a plurality of second supply voltages and outputting one of the second supply voltages;

first to fourth switches connected in series between the first selector section and the second selector section;

a first specified voltage supply section for supplying a first specified voltage to a first interconnection node between the first switch and the second switch; and a second specified voltage supply section for supplying a second specified voltage to a second interconnection node between the third switch and the fourth switch, wherein:

the first switch is connected between the first selector section and the second switch;

the second switch is connected between the first switch and the third switch;

the third switch is connected between the second switch and the fourth switch;

the fourth switch is connected between the third switch and the second selector section;

the first specified voltage supply section does not supply the first specified voltage when the first switch is on;

the second specified voltage supply section does not supply the second specified voltage when the fourth switch is on;

an output of the first specified voltage supply section has a lower impedance than that of the second selector section; and an output of the second specified voltage supply section has a lower impedance than that of the first selector section.

2. The driving voltage generation device according to claim 1, further comprising:

a first ladder resistor connected in series between a first reference node receiving a first reference voltage and a second reference node receiving a second reference voltage for generating N (N is a natural number) first supply voltages of different voltage levels; and a second ladder resistor connected in series between a third reference node receiving a third reference voltage and a fourth reference node receiving a fourth reference voltage for generating M (M is a natural number) second supply voltages of different voltage levels, wherein:

the first selector section outputs one of the N first supply voltages generated by the first ladder resistor;

the second selector section outputs one of the M second supply voltages generated by the second ladder resistor;

the first specified voltage supply section includes a fifth switch connected between a first input node receiving the first specified voltage and the first interconnection node;

the second specified voltage supply section includes a sixth switch connected between a second input node receiving the second specified voltage and the second interconnection node;

the fifth switch is off when the first switch is on; and the sixth switch is off when the fourth switch is on.

3. The driving voltage generation device according to claim 2, wherein:

an on resistance of the fifth switch is smaller than a resistance of the second ladder resistor; and an on resistance of the sixth switch is smaller than a resistance of the first ladder resistor.

4. The driving voltage generation device according to claim 2, wherein:

the first reference voltage is higher than the second reference voltage;

the third reference voltage is higher than the fourth reference voltage;

the first specified voltage satisfies $$(\text{second reference voltage}) \leqq (\text{first specified voltage}) \leqq (\text{first reference voltage});$$

and the second specified voltage satisfies $$(\text{fourth reference voltage}) \leqq (\text{second specified voltage}) \leqq (\text{third reference voltage}).$$

5. The driving voltage generation device according to claim 2, wherein:

the first ladder resistor includes N first taps for outputting the N supply voltages;

the second ladder resistor includes M second taps for outputting the M supply voltages;

the first selector section includes N first selection transistors corresponding respectively to the N first taps included in the first ladder resistor;

the second selector section includes M second selection transistors corresponding respectively to the M second taps included in the second ladder resistor;

each of the N first selection transistors is connected between the corresponding first tap and the first switch transistor; and each of the M second selection transistors is connected between the corresponding second tap and the second switch transistor.

6. The driving voltage generation device according to claim 2, further comprising a control section for controlling the first to sixth switch transistors, the control section having first to fourth modes, wherein:

in the first mode, the control section turns off the first, second and sixth switch transistors and turns on the third, fourth and fifth switch transistors;

in the second mode, the control section turns off the first, third and sixth switch transistors and turns on the second, fourth and fifth switch transistors;

in the third mode, the control section turns on the first, second and sixth switch transistors and turns off the third, fourth and fifth switch transistors; and in the fourth mode, the control section turns on the first, third and sixth switch transistors and turns off the second, fourth and fifth switch transistors.

7. The driving voltage generation device according to claim 1, further comprising:

a first differential amplifier circuit connected between the first selector section and the first switch; and a second differential amplifier circuit connected between the second selector section and the fourth switch.

8. A driving voltage generation device, comprising:

a first selector section for receiving a plurality of first supply voltages and selecting one of the first supply voltages;

a supply current generation section for generating a supply current having a current value according to an amplitude signal indicating a predetermined potential difference;

first to fourth switches connected in series between the first selector section and the supply current generation section;

a first line connecting the first selector section and the first switch with each other;

a second line connecting the supply current generation section and the fourth switch with each other;

a second resistor connected between a first node along the first line and a second node along the second line;

a clamp circuit connected to the first line for restricting a potential at the first line within a predetermined range;

a first specified voltage supply section for outputting a first specified voltage to a first interconnection node between the first switch and the second switch; and a second specified voltage supply section for outputting a second specified voltage to a second interconnection node between the third switch and the fourth switch, wherein:

the first switch is connected between the first selector section and the second switch;

the second switch is connected between the first switch and the third switch;

the third switch is connected between the second switch and the fourth switch;

the fourth switch is connected between the third switch and the supply current generation section;

the first specified voltage supply section does not output the first specified voltage when the first switch is on;

the second specified voltage supply section does not output the second specified voltage when the fourth switch is on;

an impedance of an output of the first specified voltage supply section is lower than that of an output of the supply current generation section; and an impedance of an output of the second specified voltage supply section is lower than that of an output of the first selector section.

9. The driving voltage generation device according to claim 8, further comprising a first differential amplifier circuit connected between the first node along the first line and the first selector section, wherein:

the supply current generation section includes:

a first supply transistor and a second resistor connected in series between a first reference node and a second reference node;

a second differential amplifier circuit having one input terminal connected to an interconnection node between the first supply transistor and the second resistor, another input terminal at which to receive the amplitude signal, and an output terminal connected to a gate of the first supply transistor; and a second supply transistor, a first clamp transistor and a second clamp transistor connected in series between the second node along the second line and the first reference node;

the second supply transistor is connected between the first reference node and the first clamp transistor, and receives at the gate thereof a gate voltage generated at the gate of the first supply transistor;

the first clamp transistor is connected between the first supply transistor and the second clamp transistor, and receives at the gate thereof a first bias voltage; and the second clamp transistor is connected between the second node along the second line and the first clamp transistor, and receives at the gate thereof a second bias voltage.

10. The driving voltage generation device according to claim 9, wherein a voltage value of the first bias voltage is such that a gate-source voltage of the first clamp transistor is equal to a voltage value of the amplitude information.

11. The driving voltage generation device according to claim 9, wherein a voltage value of the second bias voltage is equal to a gate-source voltage of the second clamp transistor.

12. The driving voltage generation device according to claim 9, further comprising:

a first differential amplifier circuit connected between the first node along the first line and the first selector section; and a second differential amplifier circuit connected between the second node along the second line and the fourth switch.

13. The driving voltage generation device according to claim 8, further comprising a first differential amplifier circuit connected between the first node along the first line and the first selector section, wherein:

the supply current generation section includes:

a first supply transistor and a second resistor connected in series between a first reference node and a second reference node;

a second differential amplifier circuit having one input terminal connected to an interconnection node between the first supply transistor and the second resistor, another input terminal at which to receive the amplitude signal, and an output terminal connected to a gate of the first supply transistor;

a second supply transistor, a first clamp transistor, a second clamp transistor and a third supply transistor connected in series between the first reference node and a third reference node; and a third clamp transistor and a fourth supply transistor connected in series between the second node along the second line and the third reference node;

the second supply transistor is connected between the first reference node and the first clamp transistor, and receives at the gate thereof a gate voltage generated at the gate of the first supply transistor;

the first clamp transistor is connected between the first supply transistor and the second clamp transistor, and receives at the gate thereof a first bias voltage;

the second clamp transistor is connected between the first clamp transistor and the third supply transistor, and receives at the gate thereof a second bias voltage;

the third supply transistor is connected between the second clamp transistor and the third reference node, with a gate and a drain thereof being connected to each other;

the third clamp transistor is connected between the second node along the second line and the fourth supply transistor, and receives at the gate thereof a third bias voltage; and the fourth supply transistor is connected between the third clamp transistor and the third reference node, and receives at the gate thereof a gate voltage generated at the gate of the third supply transistor.

14. The driving voltage generation device according to claim 13, wherein:

a gate-source voltage of the second clamp transistor is equal to a gate-source voltage of the third clamp transistor; and the second and third bias voltages are equal to the gate-source voltage of the second clamp transistor and/or the gate-source voltage of the third clamp transistor.

15. A method for controlling a driving voltage generation device, the driving voltage generation device comprising:

a first selector section for receiving a plurality of first supply voltages and outputting one of the first supply voltages;

a second selector section for receiving a plurality of second supply voltages and outputting one of the second supply voltages;

first to fourth switches connected in series between the first selector section and the second selector section;

a fifth switch connected between a first interconnection node and a first input node receiving a first specified voltage, the first interconnection node being present between the first switch and the second switch; and a sixth switch connected between a second interconnection node and a second input node receiving a second specified voltage, the second interconnection node being present between the third switch and the fourth switch, wherein:

an impedance of the first specified voltage supplied via the fifth switch is lower than that of an output of the second selector section; and an impedance of the second specified voltage supplied via the sixth switch is lower than an output of the first selector section, the control method comprising:

a step (A) of turning off the first, second and sixth switches and turning on the third, fourth and fifth switches;

a step (B) of turning on the first, second and sixth switches and turning off the third, fourth and fifth switches;

a step (C) of turning off the third switch and turning on the second switch, and then turning on the first and sixth switches and turning off the fourth and fifth switches, the step (C) being performed when an operation is switched from the step (A) to the step (B); and a step (D) of turning off the second switch and turning on the third switch, and then turning on the fourth and fifth switches and turning off the first and sixth switches, the step (D) being performed when an operation is switched from the step (B) to the step (A).

* * * * *